US011313112B2

(12) United States Patent
Larson

(10) Patent No.: US 11,313,112 B2
(45) Date of Patent: Apr. 26, 2022

(54) DRAIN ADAPTER DEVICE

(71) Applicant: OATEY CO., Cleveland, OH (US)

(72) Inventor: David D. Larson, Golden, CO (US)

(73) Assignee: OATEY CO., Cleveland, OH (US)

( * ) Notice: Subject to any disclaimer, the term of this patent is extended or adjusted under 35 U.S.C. 154(b) by 0 days.

(21) Appl. No.: 16/386,482

(22) Filed: Apr. 17, 2019

(65) Prior Publication Data

US 2019/0316334 A1 Oct. 17, 2019

Related U.S. Application Data

(60) Provisional application No. 62/775,114, filed on Dec. 4, 2018, provisional application No. 62/677,435, filed on May 29, 2018, provisional application No. 62/658,885, filed on Apr. 17, 2018.

(51) Int. Cl.
*E03C 1/20* (2006.01)
*E03F 5/04* (2006.01)

(52) U.S. Cl.
CPC ..... *E03C 1/20* (2013.01); *E03F 5/0408* (2013.01); *E03F 5/0409* (2013.01); *E03F 2005/0413* (2013.01); *E03F 2005/0414* (2013.01)

(58) Field of Classification Search
CPC ..... E03F 5/0408; E03F 5/0407–0409; E03C 1/20
USPC ..... 4/613
See application file for complete search history.

(56) References Cited

U.S. PATENT DOCUMENTS

| | | | | |
|---|---|---|---|---|
| 4,332,393 | A * | 6/1982 | Cuschera | E03C 1/22 277/606 |
| 9,790,693 | B2 * | 10/2017 | Wilde | E03F 5/0408 |
| 10,683,654 | B2 * | 6/2020 | Priester | E03F 5/0407 |
| 2018/0073237 | A1 * | 3/2018 | Say | E03F 5/0411 |
| 2019/0242107 | A1 * | 8/2019 | McLeod | E03F 5/0408 |

* cited by examiner

*Primary Examiner* — Christine J Skubinna
(74) *Attorney, Agent, or Firm* — BakerHostetler

(57) ABSTRACT

Described herein are embodiments of a drain adapter device configured as a low-profile drain that provides a dry seal between a drain base and an installed floor drain. The low-profile drain is configured to receive threaded drain gates or strainers. In some embodiments, the drain adapter device provides a low-profile drain system that includes universal receiving features configured to engage with strainers, drain gates, caps, and the like.

9 Claims, 30 Drawing Sheets

DRAIN ADAPTER DEVICE

CROSS REFERENCE TO RELATED APPLICATIONS

The present application claims the benefit of and priority, under 35 U.S.C. § 119, to U.S. Provisional Application Ser. No. 62/658,885, filed Apr. 17, 2018, entitled "Drain Adapter Device"; 62/677,435, filed May 29, 2018, entitled "Drain Adapter Device"; and 62/775,114, filed Dec. 4, 2018, entitled "Drain Adapter Device." The entire disclosures of the applications listed above are hereby incorporated herein by reference, in their entirety, for all that they teach and for all purposes.

FIELD

The present disclosure is generally directed to drain adapters, in particular, toward floor and shower drain adapters.

BACKGROUND

Many tiled drain systems, especially tiled shower drain systems, include a drain base installed in a wooden subfloor of a shower. The drain base serves as an interconnection from the shower to a drainage system, waste line, and/or vent system of a building. Typically, the drain base includes a flange disposed around a periphery of the drain base that is configured to set a height of the drain base relative to the subfloor. In some cases, a surface of the flange may contact the subfloor seating the drain base to the subfloor.

In some installations, a clamping collar may be fastened to the drain base providing a threaded interface for a head adapter of the drain. The threaded interface may be a threaded hole disposed in a center of the clamping collar. A weep path may be provided in spaces between the clamping collar and the drain base, and/or the head adapter and the clamping collar, to allow water that collects underneath installed tile to move toward and through the drain to the drainage system of the building. The drain base, the clamping collar, and the head adapter may form what is known as the drain.

Prior to finishing a tiled shower including this type of drain, a tiler is required to install a primary sloped mortar bed (sloping toward the drain), a waterproof pan liner on top of the primary sloped mortar bed, and a secondary sloped mortar bed disposed on top of the waterproof pan liner. As the head adapter is threadedly-engaged with the clamping collar, the height of the head adapter relative to the subfloor may be adjusted to suit an overall height for the mortar and tile to be installed. Once the mortar has set, tile can then be laid on top of the secondary mortar bed around the head adapter of the drain. The primary and/or secondary mortar also maintains the drain base, clamping collar, and even the head adapter in a fixed position relative to the subfloor.

These conventional tiled drain installations can result in several issues. For example, the installation provides a vapor path, for moisture to travel from an area between the floor tile and the waterproof pan liner to the walls of a building and/or other structural elements. As another example, the weep paths provide a flow path for waste water to flow through in the event of a drain clog and/or backup. In any event, the unwanted water may collect as described and cause mold problems, wet rot, and/or structural issues for a building.

SUMMARY

Some manufacturers have attempted to solve the problem of unwanted water and vapor migration by providing an enclosed shower system including a number of interconnected waterproof membranes surrounding a drain with an integrated bonding flange. Among other things, the drain with integrated bonding flange requires an adapter ring to be fastened to a pre-installed drain base using a gasket material and sealant. Once attached, the drain with integrated bonding flange may be interconnected to the adapter ring and mortared in place. For instance, the mortar may be disposed between the subfloor and the integrated flange maintaining the drain with integrated bonding flange in place. Further, the drain with integrated bonding flange requires a center drain gate support section to be bonded in place, as part of the drain, to set a final height of the drain relative to the subfloor.

To receive a drain gate, these types of drains require a center support section (e.g., a hollow pipe) which is adjusted to a desired tile height (e.g., cut to length), excluding the drain gate thickness, and then set in place with mortar. The installed drain gate extends above the center support section, and the integrated bonding flanges of the drain, providing a final height from the assembly from the subfloor. As can be appreciated, these types of drains (with integrated bonding flanges) provide a tall drain assembly (e.g., measured from the subfloor to the top of an installed drain gate that is coincident with the top of set tile) based on the number of required components and how each component interconnects with one another. Further, these types of drains do not provide a completely sealed interface for a mortared shower that prevents the unwanted migration of vapor and/or water along a path through the mortar. Moreover, these types of drains are configured to receive a specific type of drain gate and do not accommodate or receive threaded drain gates and/or strainer inserts.

Embodiments described herein include a drain adapter device configured as a low-profile drain that, among other things, provides a dry seal between the drain base and installed floor drain components and can receive threaded drain gates and/or strainers. In some embodiments, the drain adapter device can provide an installation height (e.g., measured from the subfloor to installed tile) that is less than 60% of the height of other drain systems.

In some embodiments, the drain adapter device may provide a low-profile drain system that includes universal receiving features configured to engage with strainers, drain gates, caps, etc. In one embodiment, the universal receiving features may include standard threaded engagement features that threadedly-engage with mating features of a strainer, drain gate, cap, etc.

The previously mentioned issues and other needs are addressed by the various aspects, embodiments, and/or configurations of the present disclosure. Also, while the disclosure is presented in terms of exemplary embodiments, it should be appreciated that individual aspects of the disclosure can be separately claimed.

It shall be understood that the term "means" as used herein shall be given its broadest possible interpretation in accordance with 35 U.S.C., Section 112, Paragraph 6. Accordingly, a claim incorporating the term "means" shall cover all structures, materials, or acts set forth herein, and all of the equivalents thereof. Further, the structures, materials or acts and the equivalents thereof shall include all those described in the summary of the invention, brief description of the drawings, detailed description, abstract, and claims themselves.

The preceding is a simplified summary of the disclosure to provide an understanding of some aspects of the disclosure. This summary is neither an extensive nor exhaustive overview of the disclosure and its various aspects, embodiments, and/or configurations. It is intended neither to identify key or critical elements of the disclosure nor to delineate the scope of the disclosure but to present selected concepts of the disclosure in a simplified form as an introduction to the more detailed description presented below. As will be appreciated, other aspects, embodiments, and/or configurations of the disclosure are possible utilizing, alone or in combination, one or more of the features set forth above or described in detail below

In the appended figures, similar components and/or features may have the same reference label. Further, various components of the same type may be distinguished by following the reference label by a letter that distinguishes among the similar components. If only the first reference label is used in the specification, the description is applicable to any one of the similar components having the same first reference label irrespective of the second reference label.

DETAILED DESCRIPTION

Embodiments of the present disclosure will be described in connection with low-profile drain systems and, in particular, shower drain systems. In some embodiments, the devices and systems disclosed herein may interconnect with one or more existing, or pre-installed, plumbing components in a building or structure.

Figure 1A:
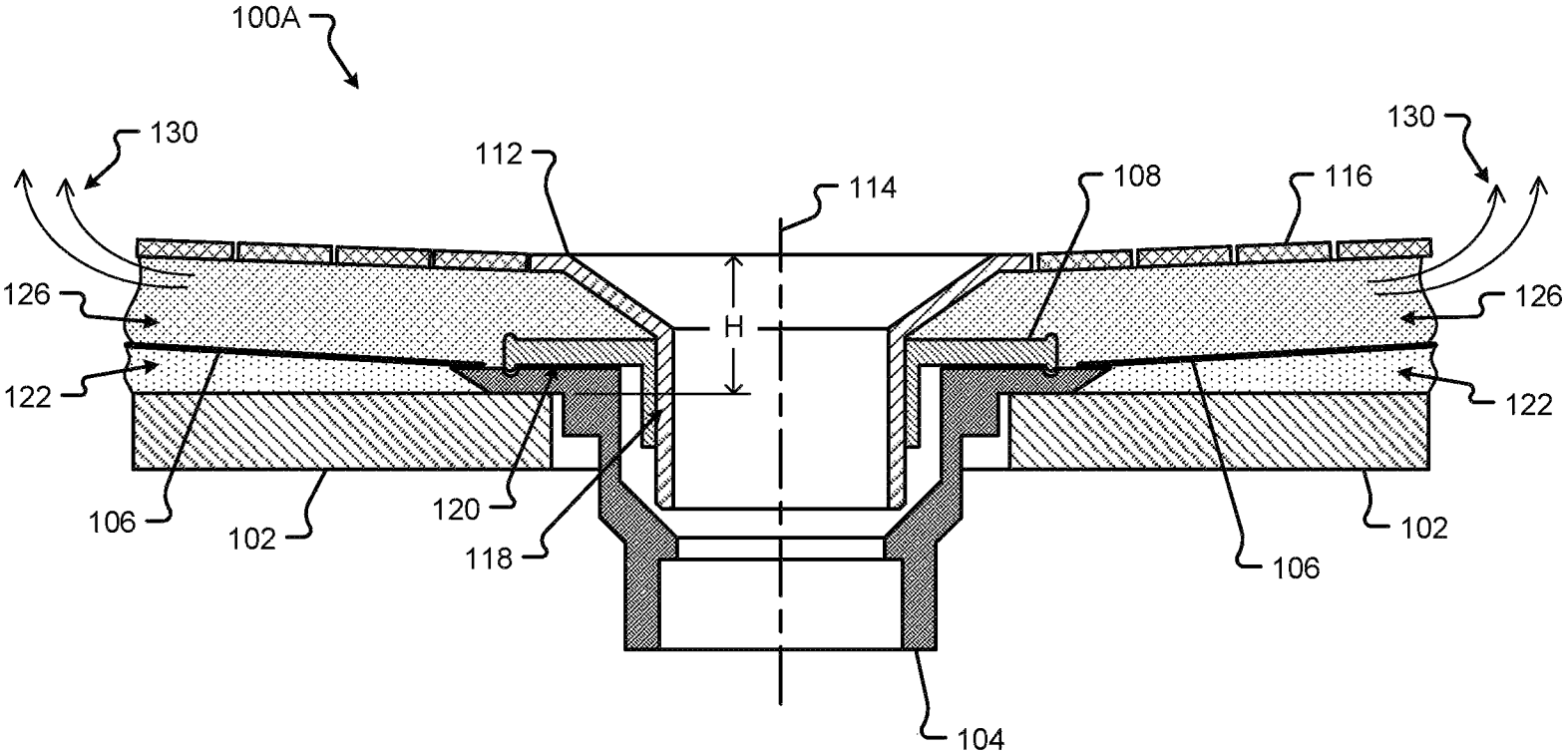
Fig. 1A (Prior Art)
FIG. 1A is a section view of a conventional drain system in a tiled environment.

Referring to FIG. 1A, a section view of a conventional drain system 100A is shown in a tiled environment. The drain system 100A may include a subfloor 102 including an aperture, or hole, with a drain base 104 disposed therein. In some embodiments, the drain base 104 may include a flanged rim, or flange, that sits on the subfloor 102, such that the subfloor 102 cannot pass therethrough. Attached to the drain base 104 is a clamping collar 108. The clamping collar 108 may be fastened to the drain base 104 via one or more screws or bolts at a collar attachment interface 120. The clamping collar 108 may include a set of internal threads configured to engage with mating threads of a head adapter 112 at a threaded interface 118. The head adapter 112 may include a strainer, drain gate, and/or other drain filter feature. The distance from the subfloor 102 to the top of the head adapter 112 may define a drain height, H. As shown in FIG. 1A, the components may be substantially centerline symmetrical about drain center axis 114.

The drain system 100A offers a number of features designed to seal a tiled environment relative to the drain base 104. For instance, once the drain base 104 is set inside the subfloor 102, a primary sloped mortar bed 122 may be formed around a periphery of the drain base 104 including a gradual slope downward toward the drain center axis 114 of the drain base 104. This slope allows water to gradually drain toward the drain base 104 and into a connected waste line. After the primary sloped mortar bed 122 has been formed, a waterproof membrane 106 (e.g., waterproof liner, etc.) may be disposed on top of the primary sloped mortar bed 122 and a portion of the periphery of the drain base 104. The waterproof membrane 106 allows water that may collect under the tile 116 and in the mortar to move along a surface of the waterproof membrane 106, through one or more weep paths of the drain base 104 and/or clamping collar 108, into the drain (and connected line).

After the waterproof membrane 106 has been installed, the secondary sloped mortar bed 126 may be formed on the waterproof membrane 106, the drain base 104, and/or the clamping collar 108, around a periphery of the head adapter 112. Similar to the primary sloped mortar bed 122, the secondary sloped mortar bed 126 includes a gradual slope downward toward the drain center axis 114 of the drain base 104. This slope disposes the tile 116 at a sloped angle to the drain system 100A, draining water toward the center of the drain base 104 and into a connected waste line.

Among other things, the drain system 100A illustrated in FIG. 1A creates a vapor and/or fluid path 130 in the secondary sloped mortar bed 126. In some embodiments, water may collect in the secondary sloped mortar bed 126, between the tile 116 and the waterproof membrane 106, during routine use of the drain system 100A (e.g., use of a shower, etc.). In some embodiments, for example during a drain backup, fluid may move from the drain base 104 and/or connected waste line, through the weep paths in the collar attachment interface 120 and/or drain base 104 into the secondary sloped mortar bed 126. This backed-up material may then flow from the secondary sloped mortar bed 126 to one or more structural elements and/or unprotected areas in the structure/building along one or more vapor/fluid paths 130. As can be appreciated, this drain system 100A may not adequately seal the walls or environment around a drain from unwanted intrusion of moisture.

Figure 1B:
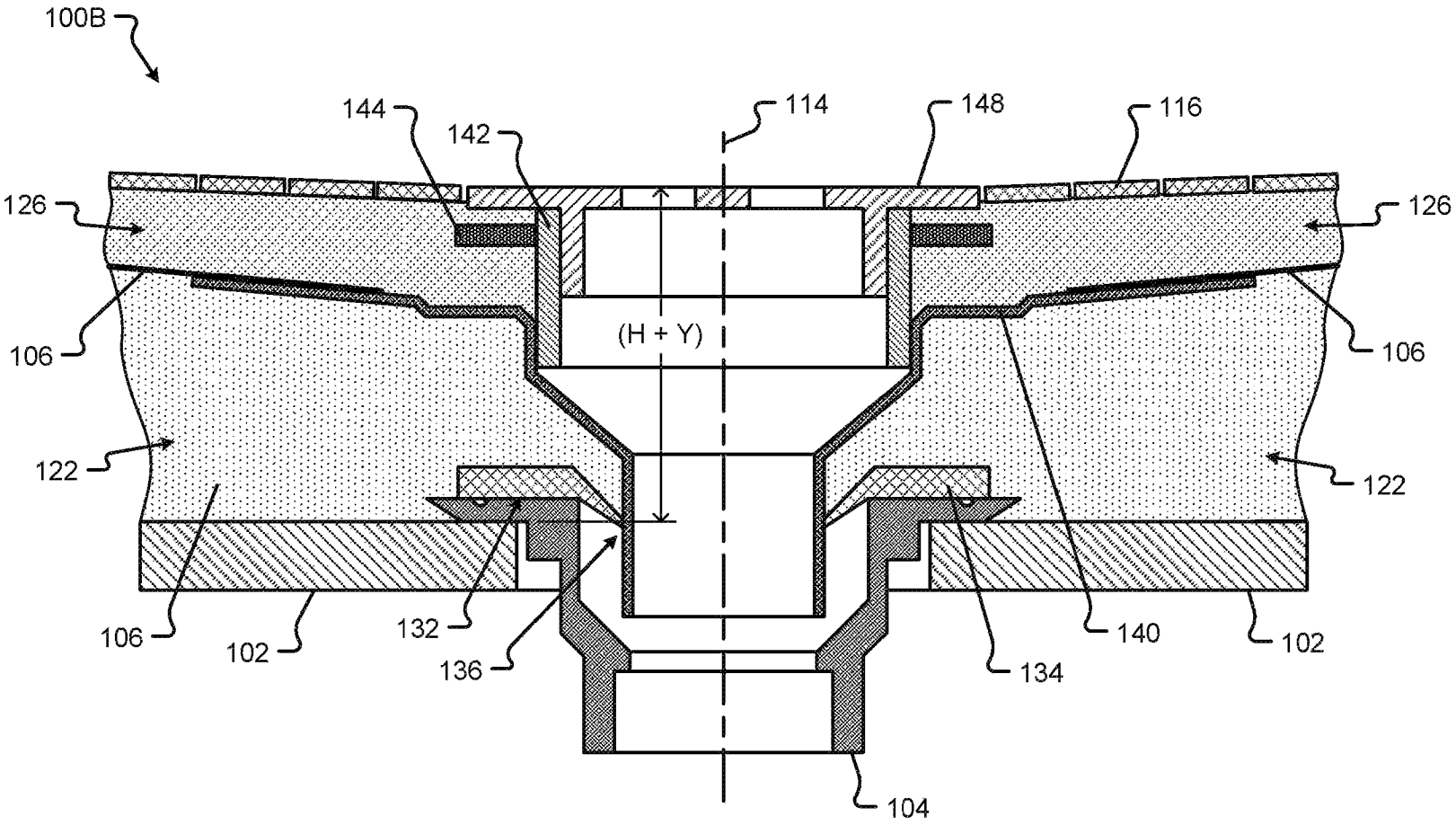
FIG. 1B is a section view of a drain system in a tiled environment in accordance with embodiments of the present disclosure.

FIG. 1B is a section view of a drain system 100B in a tiled environment in accordance with embodiments of the present disclosure. In FIG. 1B, the same subfloor 102 and drain base 104 are installed in a structure as described in conjunction with FIG. 1A. In some embodiments, the integrated flange drain system 100B may include an adapter ring 134 including a flexible seal area 136 configured to receive a pipe stem of a drain with integrated bonding flange 140. As the stem of the drain with integrated bonding flange 140 is inserted into an area of the drain base 104, the adapter ring 134 may elastically stretch around the stem providing the flexible seal area 136 around a complete periphery of the stem of the drain with integrated bonding flange 140.

Similar to the drain system 100A described in conjunction with FIG. 1A, the integrated flange drain system 100B includes a primary sloped mortar bed 122, a waterproof membrane 106, and a secondary sloped mortar bed 126. In addition, the secondary sloped mortar bed 126 shown in the integrated flange drain system 100B of FIG. 1B supports a number of tiles 116 at a sloped, or angled, orientation relative to the drain base 104 and/or the drain center axis 114. The drain with integrated bonding flange 140 includes a sloped bonding flange extending outwardly from the drain center axis 114 a distance to engage with the waterproof membrane 106 and/or the secondary sloped mortar bed 126. This bonding flange provides a number of benefits, including an enhanced mortar bonding surface and a larger waterproof membrane 106 contact area.

Disposed at the center of the drain with integrated bonding flange 140, is a center support ring 142 (e.g., configured as a section of tubing) including an internal diameter configured to receive and engage with a drain gate 148. In some embodiments, the engagement may include a simple slip fit tube-in-tube engagement. In one embodiment, the integrated flange drain system 100B may include an adjustable flange 144 disposed around an outer diameter of the center support ring 142 configured to provide mortar setting surfaces for the integrated flange drain system 100B. The adjustable flange 144 may be moved vertically, in either direction along the drain center axis 114, to suit a desired height of the tile 116 relative to the subfloor 102, e.g., height (H+Y). In some embodiments, this height (H+Y) may be defined by the design of the integrated flange drain system 100B. As can be appreciated, the height (H+Y) may be equal to the height, H, of the drain system 100A shown in FIG. 1A and an additional amount, Y, representing a dimension of the number of components making up the integrated flange drain system 100B above those shown in the drain system 100A of FIG. 1A.

FIGS. 2-9 describe various embodiments of a low-profile drain system 200, 800 in accordance with embodiments of the present disclosure. The low-profile drain system 200, 800 may include a dry-seal system comprising a threaded plate 212 and threaded plate gasket 208 attached to the drain base 104. When attached, the dry-seal system prevents fluid, or vapor, from passing through the threaded plate gasket 208 and the threaded plate 212 at the sealed interface 220.

In some embodiments, the low-profile drain adapter 204, 804, shown and/or described in conjunction with FIGS. 2-9, may include a threaded stem section configured to engage with the threaded plate 212 at a threaded engagement 218. As illustrated in the figures, this threaded engagement 218 allows the low-profile drain adapter 204, 804 to be arranged closer to the drain base 104, providing a lower-profile system 200, 800 than the drain system 100B illustrated in FIG. 1B. In some embodiments, the height, (H−N), of the low-profile drain system 200, 800 may be less than the height, H, of the drain system 100A illustrated in FIG. 1A.

One or more of the components making up the low-profile drain system 200, 800 may be made from plastic, polyvinyl chloride (PVC), polymer, steel, copper, iron, combinations thereof, and/or the like.

The low-profile drain adapter 204, 804 may include a drain insert 216 that nests at least partially inside a receiving area of the low-profile drain adapter 204, 804. In one embodiment, the receiving area may orient the drain insert 216 in a position coaxial with the drain center axis 114 of the low-profile drain system 200, 800. The drain insert 216 may include insert engagement features 222 configured to receive a strainer, filter, drain gate, and/or other drain feature. The insert engagement features 222 may be configured as internal threads disposed in the drain insert 216. In some embodiments, the internal threads of the drain insert 216 may match the threads of the stem of the low-profile drain adapter 204, 208. For instance, the insert engagement features 222 may include a standard thread diameter and pitch that exactly, or substantially matches, a standard thread diameter and pitch of the threaded plate 212 and/or the stem of the low-profile drain adapter 204, 804.

Similar to the adjustable flange 144 described in conjunction with the integrated flange drain system 100B of FIG. 1B, the low-profile drain system 200, 800 may include an adjustable flange 224 that provides bonding surfaces for the secondary sloped mortar bed 126. The adjustable flange 244 may be moved vertically, in either direction along the drain center axis 114, to suit a desired height of the tile 116 relative to the subfloor 102. For example, the adjustable flange 224 may be moved to dispose the drain insert 216 a specific distance above the subfloor 102. One or more surfaces of the adjustable flange 224 may engage with one or more surfaces of the low-profile drain adapter 204. This engagement may set the height of the drain insert 216 disposed in a center aperture of the adjustable flange 224. In some embodiments, the adjustable flange 224 may engage with the drain insert 216, in a tight tolerance fit such that the drain insert 216 and the adjustable flange 224 do not move relative one another absent an outside adjustment force (e.g., not gravity).

Figure 2:
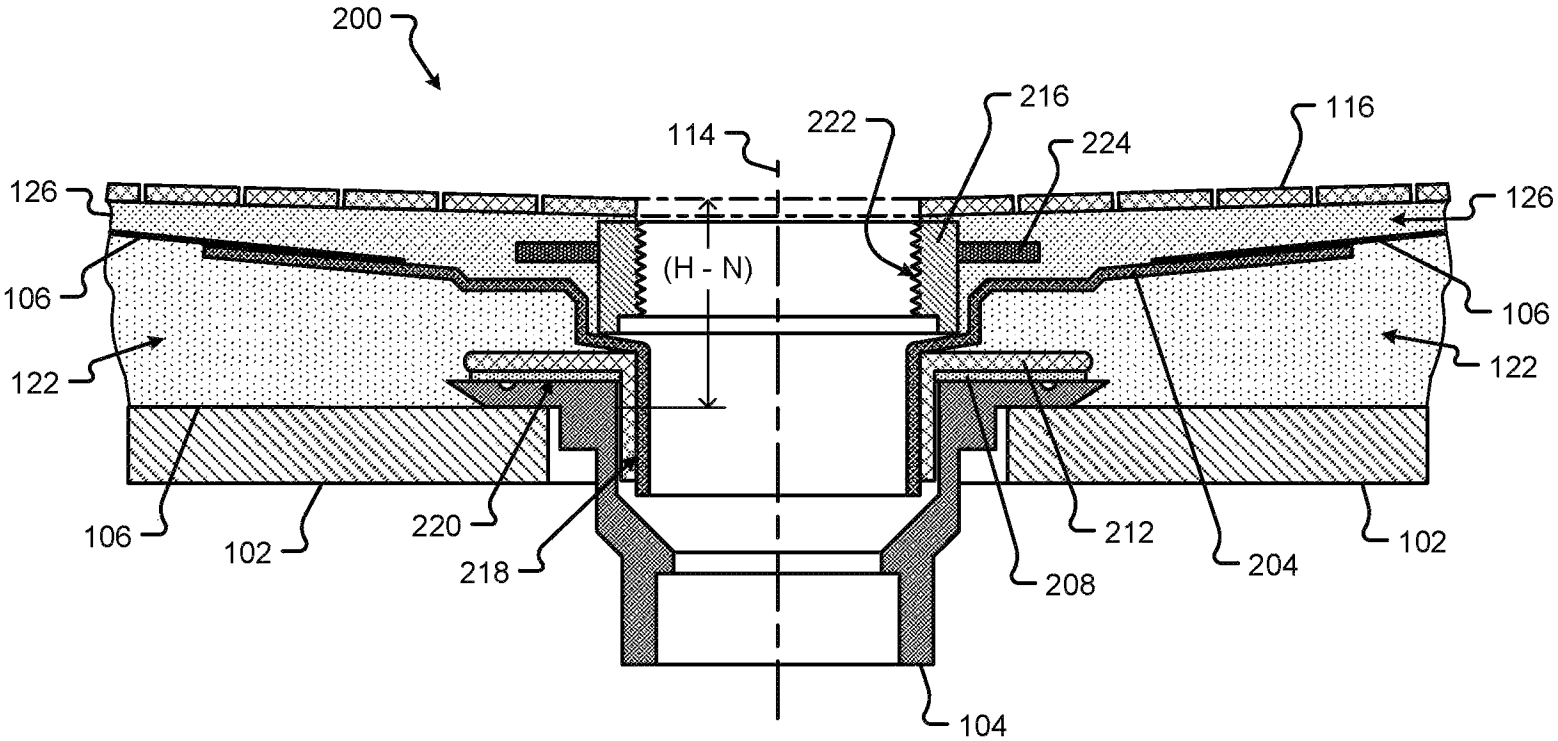
FIG. 2 is a section view of a low-profile drain system in a tiled environment in accordance with embodiments of the present disclosure.

FIG. 2 is a section view of a low-profile drain system 200 in a tiled environment in accordance with embodiments of the present disclosure. The low-profile drain system 200 shown in FIG. 2 is a schematic representation of the low-profile drain system 200.

Figure 3A:
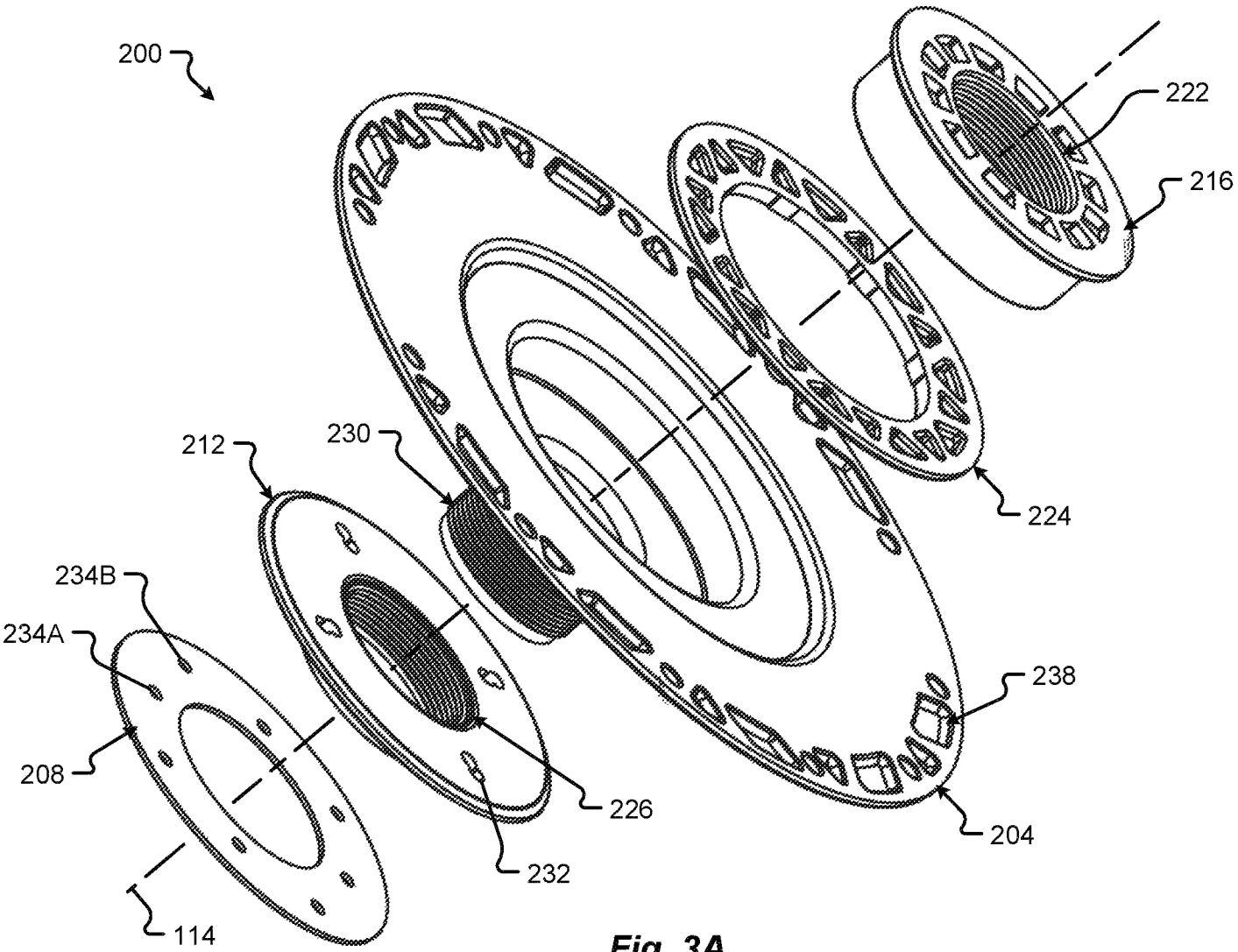
FIG. 3A is an exploded perspective view of a low-profile drain system in accordance with embodiments of the present disclosure.

FIG. 3A is an exploded perspective view of a low-profile drain system 200 in accordance with embodiments of the present disclosure. The low-profile drain system 200 in FIG. 3A, shows the various components (e.g., the threaded plate gasket 208, threaded plate 212, low-profile drain adapter 204, drain insert 216, and the adjustable flange 224) exploded along the drain center axis 114.

As shown in FIG. 3A, the drain insert 216 includes a flange disposed about a periphery of the insert body. It should be appreciated that embodiments of the present disclosure may not require the flange as shown in FIG. 3A. The low-profile drain system 200 may include a threaded plate gasket 208 made of a compliant material, such as silicone, plastic, polymer, rubber, and/or combinations thereof. In any event, the threaded plate gasket 208 may include a first set of punched, or partially-punched, mount features 234A. The first mount features 234A may be one or more holes, or partially-punched, holes disposed around a center of the threaded plate gasket 208 in a first bolt circle diameter ("BCD") having a first radius dimension measured from the center of the threaded plate gasket 208. Additionally or alternatively, the threaded plate gasket 208 may include a second set of punched, or partially-punched, mount features 234B. Similar to the first mount features 234A, the second mount features 234B may be one or more holes, or partially-punched, holes disposed around a center of the threaded plate gasket 208 in a second BCD having a second radius dimension measured from the center of the threaded plate gasket 208 that is different from the first radius dimension. In some embodiments, the first and second mount features 234A, 234B may be offset from one another by an angle.

The threaded plate 212 may include a flanged surface configured to engage with a surface of the threaded plate gasket 208 and seal the threaded plate gasket 208 to a drain base 104. The threaded plate 212 may include drain engagement features 226 disposed on an internal diameter of the plate 212. The drain engagement features 226 may correspond to internal threads configured to mate with the external threads 230 of the low-profile drain adapter 204. In addition, the threaded plate 212 may include a number of drain base mounting features 232 sized to receive and contain fasteners in either the first BCD or the second BCD. The drain base mounting features 232 may be shaped as two-holes that overlap and are disposed side-by-side through the flange of the threaded plate 212 (e.g., forming a figure "8" aperture). Although not shaped as a straight slot, it should be appreciated that the drain base mounting features 232 could be a slot disposed through the flange of the drain insert 216, without departing from the scope of the present disclosure.

In some embodiments, one or more components of the low-profile drain system 200 may include a number of mortar receiving features 238. During installation, mortar may enter the mortar receiving features 238 and set therein fixing the low-profile drain system 200 relative to the subfloor 102. While the mortar receiving features 238 are shown disposed in the low-profile drain adapter 204, the adjustable flange 224, and the drain insert 216, it should be appreciated that the low-profile drain system 200 may include more or fewer mortar receiving features 238 than shown in FIG. 3A.

Figure 3B:
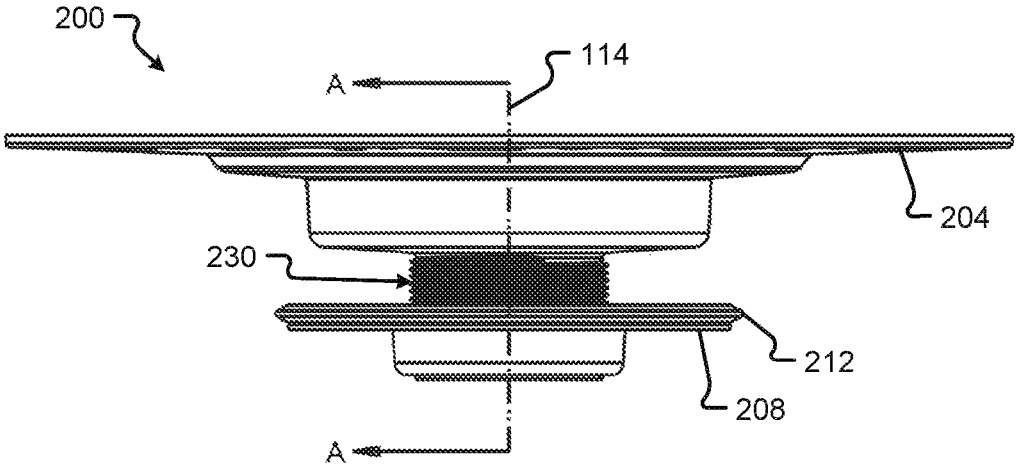
FIG. 3B is an elevation view of a low-profile drain system in accordance with embodiments of the present disclosure.
Figure 3C:
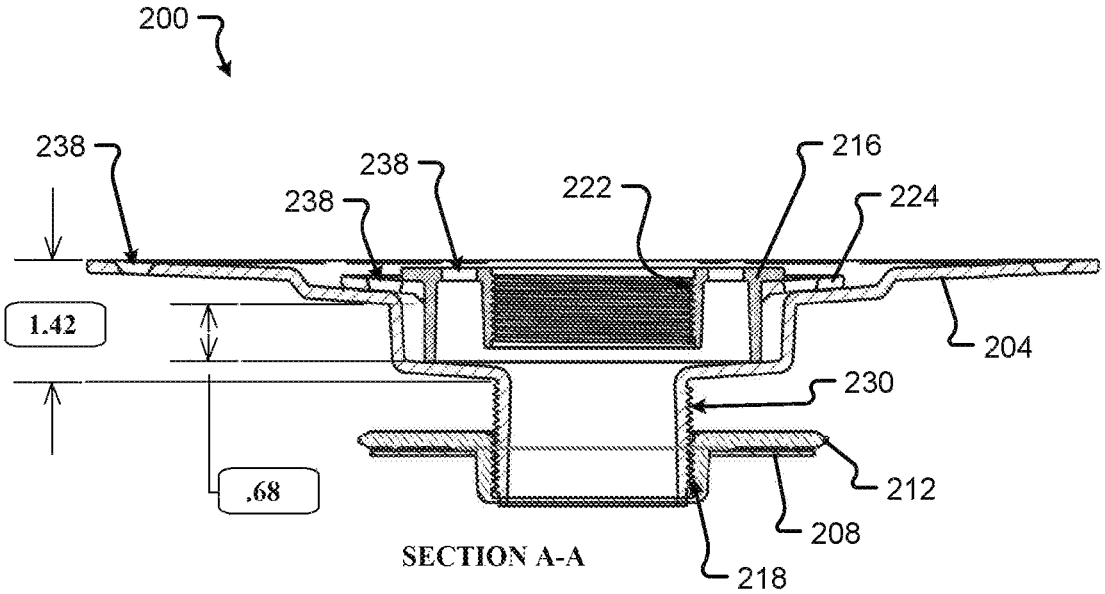
FIG. 3C is an elevation section view taken through line A-A of FIG. 3B.

FIG. 3B is an elevation view of a low-profile drain system 200, at least partially assembled, in accordance with embodiments of the present disclosure. FIG. 3C is an elevation section view taken through line A-A of FIG. 3B. FIG. 3C shows example dimensions of the low-profile drain system 200, in the at least partially assembled state, in inches. As shown in FIG. 3C, the insert engagement features 222 of the drain insert 216 are disposed inside the low-profile drain adapter 204 and below an upper portion of the low-profile drain adapter 204. This arrangement, among other things, disposes the drain insert 216 below the tile 216 and/or the tile line of the low-profile drain system 200 and provides a low-profile assembly.

Figure 4:
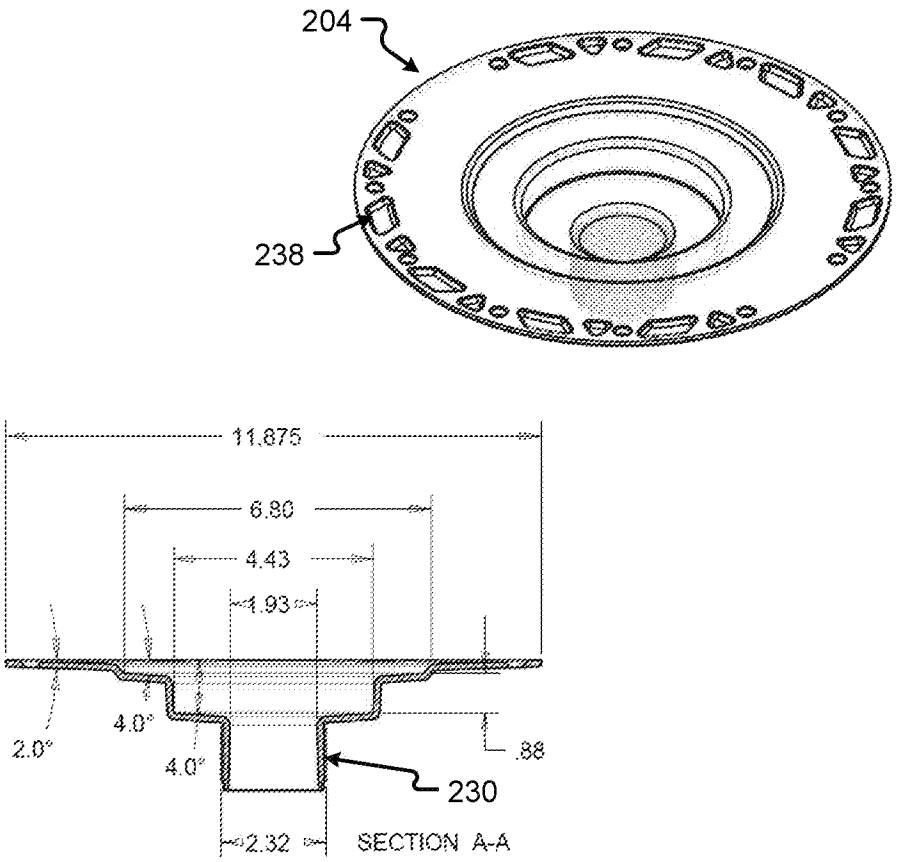
FIG. 4 shows multiple views of a low-profile drain adapter of low-profile drain system in accordance with embodiments of the present disclosure.
Figure 4:
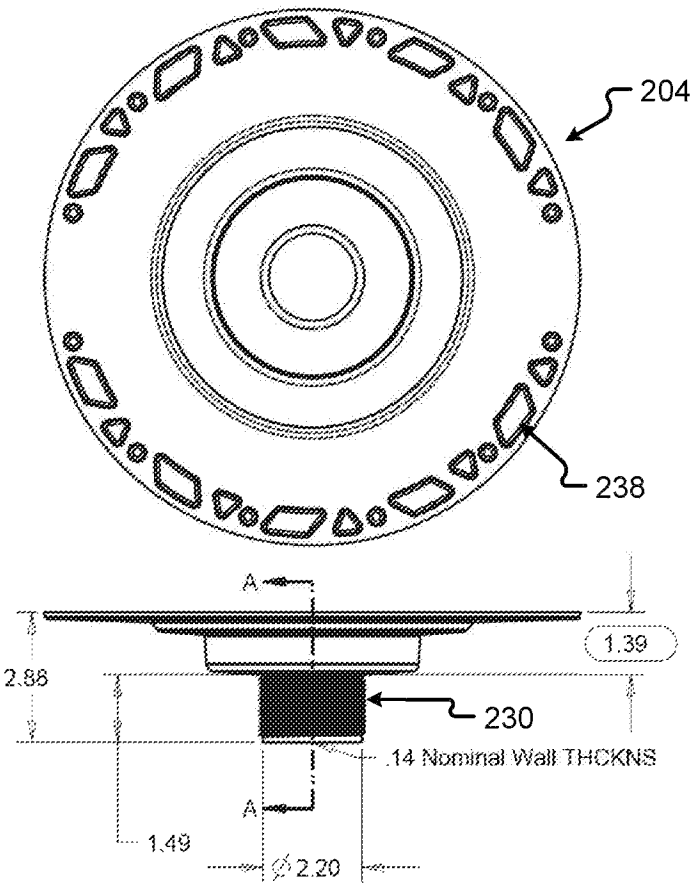

FIG. 4 shows multiple views of a low-profile drain adapter 204 of low-profile drain system 200 in accordance with embodiments of the present disclosure. In particular, FIG. 4 shows a plan view of the low-profile drain adapter 204, an elevation view of the low-profile drain adapter 204 (disposed under the plan view), an elevation section view of the low-profile drain adapter 204, and a perspective view of the low-profile drain adapter 204 in accordance with embodiments of the present disclosure.

Figure 5:
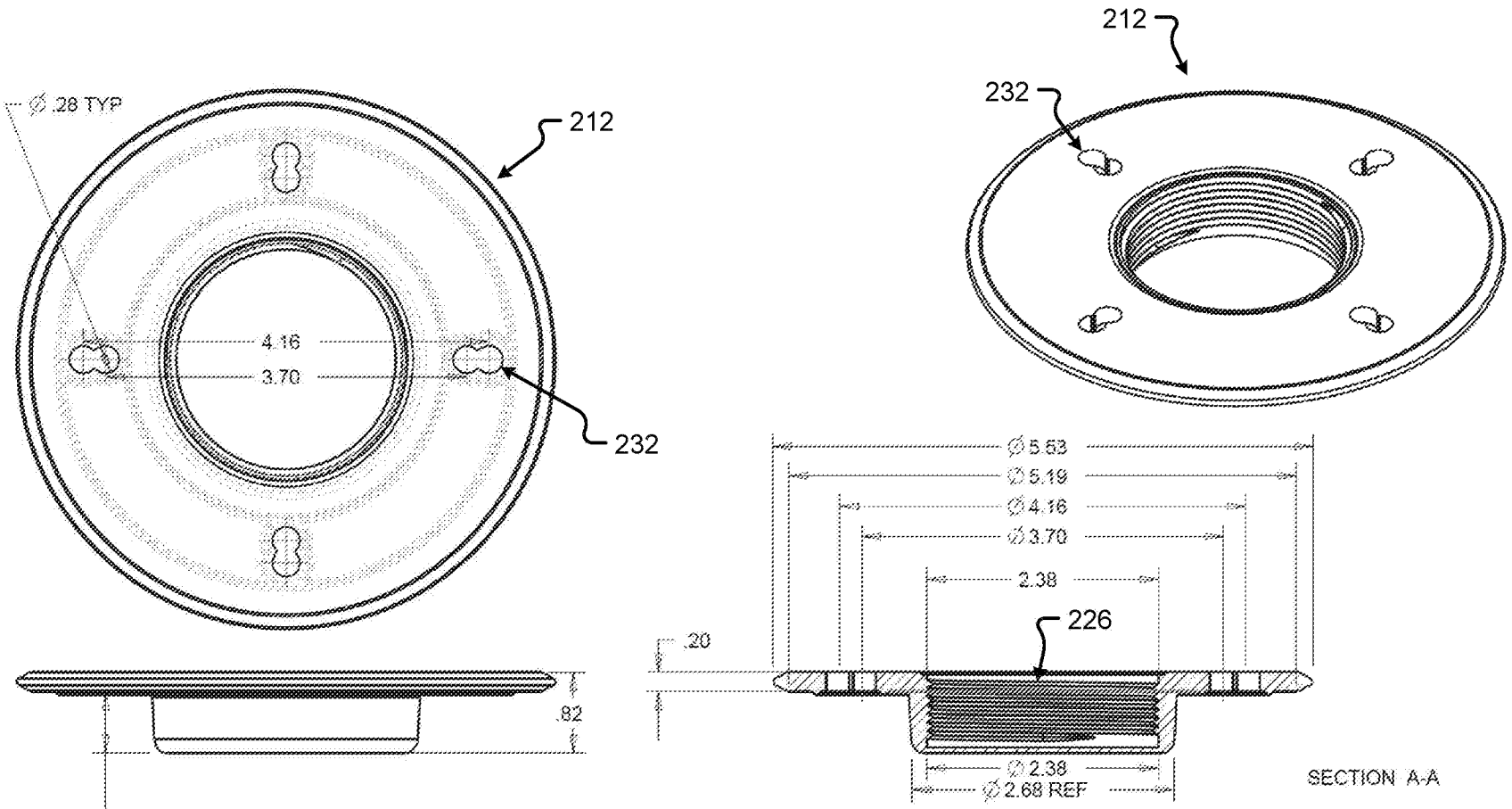
FIG. 5 shows multiple views of a threaded plate of a low-profile drain system in accordance with embodiments of the present disclosure.

FIG. 5 shows multiple views of a threaded plate 212 of a low-profile drain system 200 in accordance with embodiments of the present disclosure. In particular, FIG. 5 shows a plan view of the threaded plate 212, an elevation view of the threaded plate 212 (disposed under the plan view), an elevation section view of the threaded plate 212, and a perspective view of the threaded plate 212 in accordance with embodiments of the present disclosure.

Figure 6:
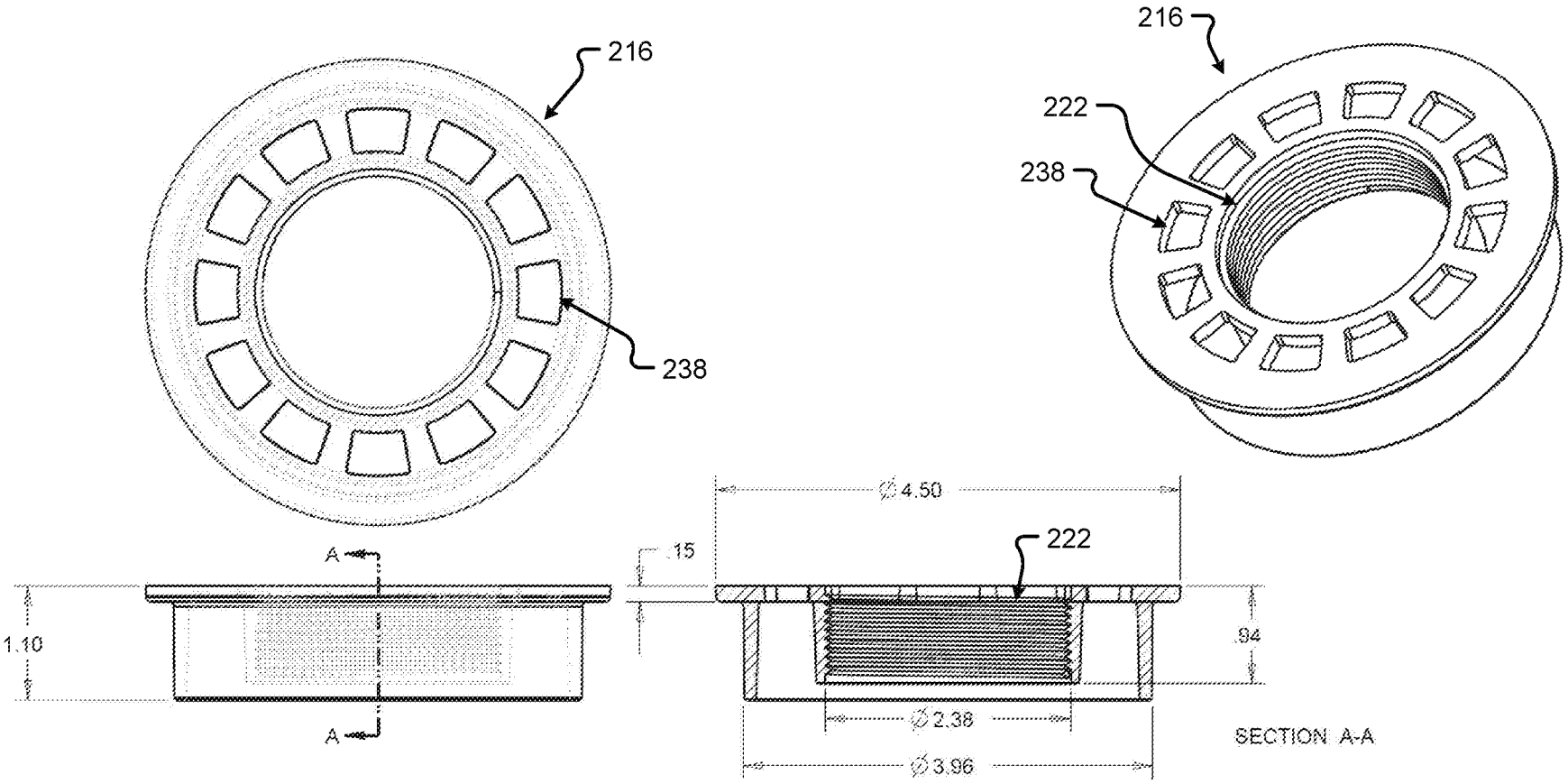
FIG. 6 shows multiple views of a drain insert of a low-profile drain system in accordance with embodiments of the present disclosure.

FIG. 6 shows multiple views of a drain insert 216 of a low-profile drain system 200 in accordance with embodiments of the present disclosure. In particular, FIG. 6 shows a plan view of the drain insert 216, an elevation view of the drain insert 216 (disposed under the plan view), an elevation section view of the drain insert 216, and a perspective view of the drain insert 216 in accordance with embodiments of the present disclosure.

Figure 7:
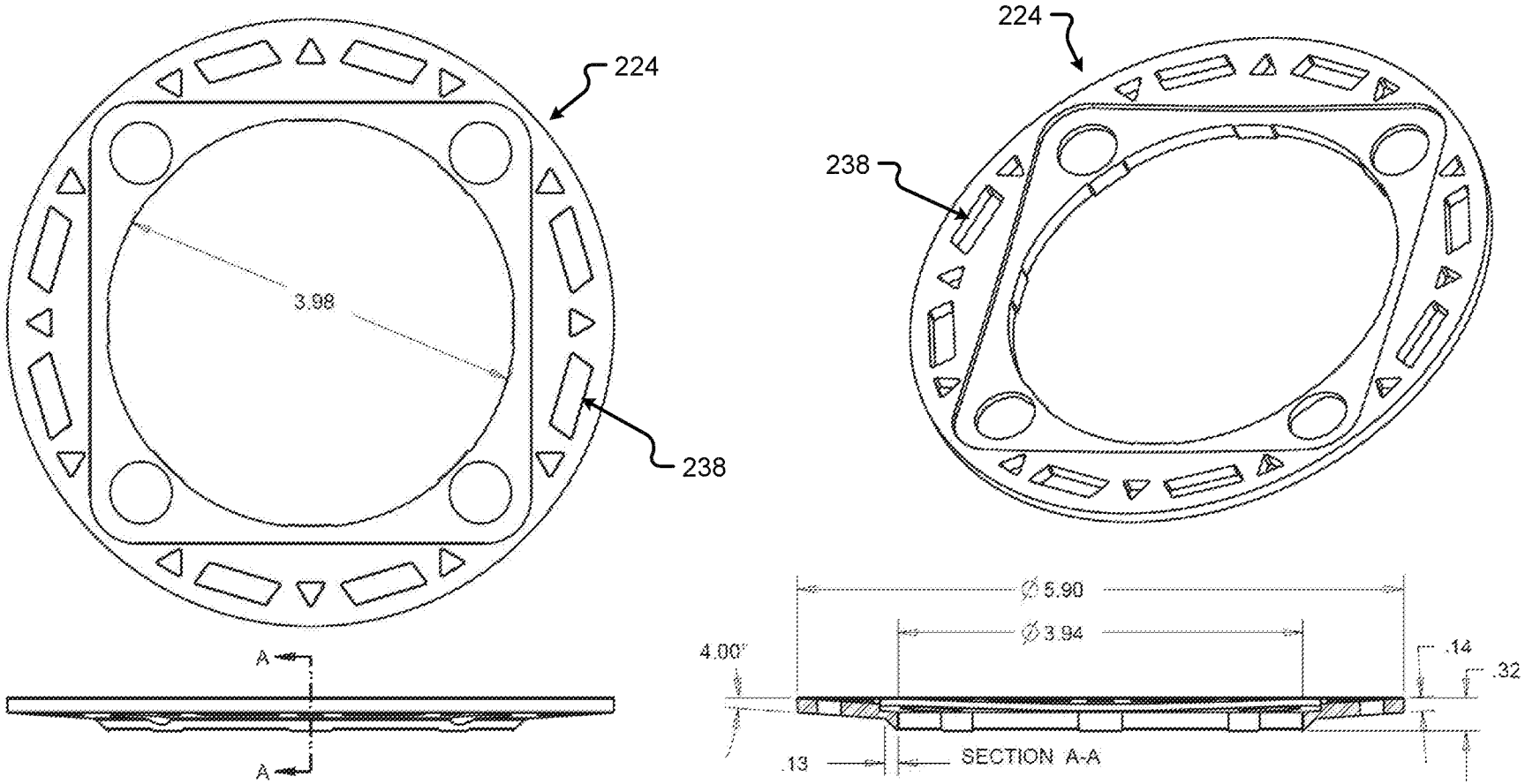
FIG. 7 shows multiple views of an adjustable flange of a low-profile drain system in accordance with embodiments of the present disclosure.

FIG. 7 shows multiple views of an adjustable flange 224 of a low-profile drain system 200 in accordance with embodiments of the present disclosure. In particular, FIG. 7 shows a plan view of the adjustable flange 224, an elevation view of the adjustable flange 224 (disposed under the plan view), an elevation section view of the adjustable flange 224, and a perspective view of the adjustable flange 224 in accordance with embodiments of the present disclosure.

Figure 8A:
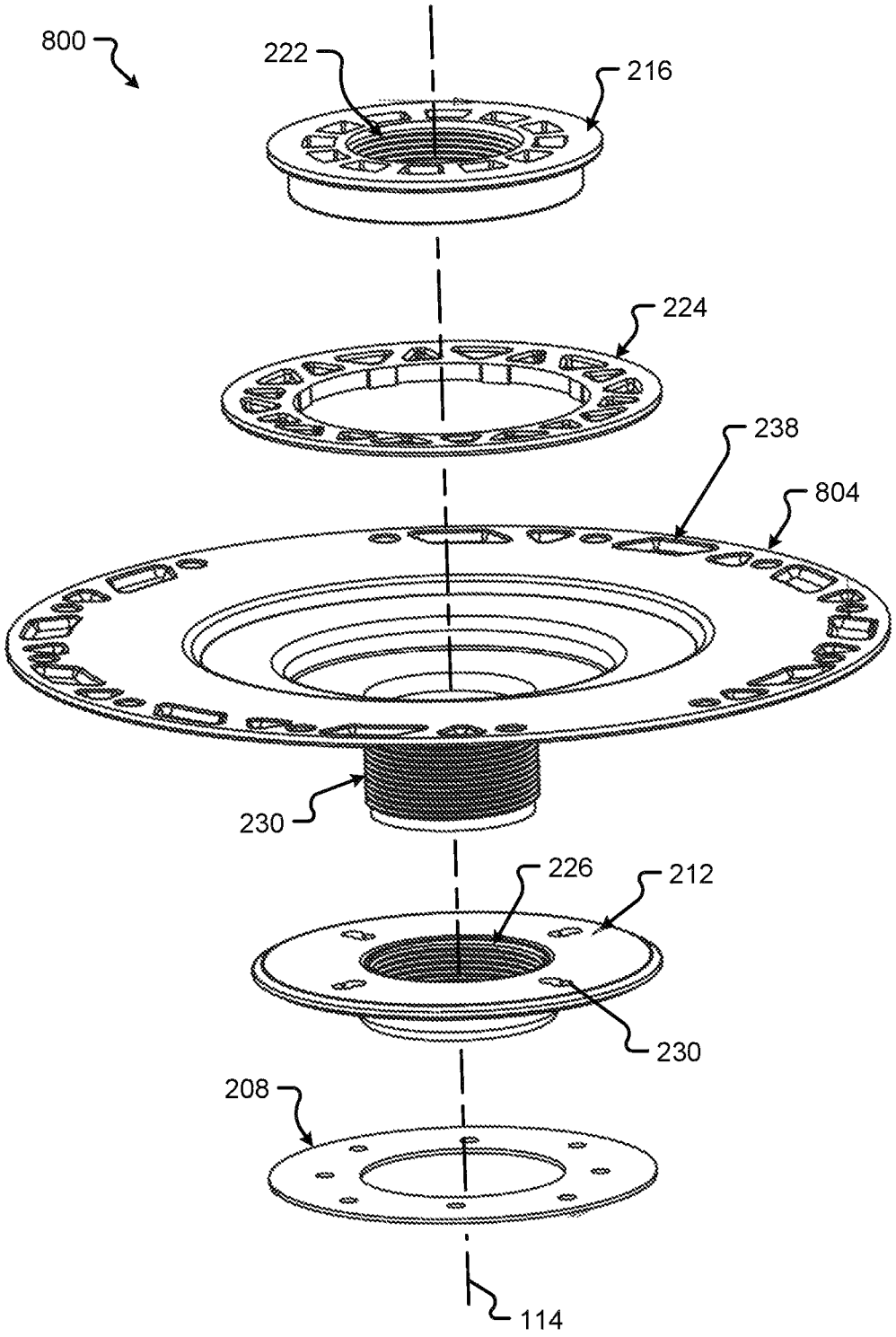
FIG. 8A is an exploded perspective view of a low-profile drain system in accordance with embodiments of the present disclosure.

FIG. 8A is an exploded perspective view of a low-profile drain system in accordance with embodiments of the present disclosure. The low-profile drain system 800 in FIG. 8A, shows the various components previously described (e.g., the threaded plate gasket 208, threaded plate 212, drain insert 216, and the adjustable flange 224) along with a low-profile drain adapter 804 exploded along the drain center axis 114. The assembly of the low-profile drain system 800 may be the same as, or similar to, the assembly of the low-profile drain system 200 described above. In some embodiments, the low-profile drain system 800 may include a low-profile drain adapter 804 having a condensed height that is shorter, in dimension, than the low-profile drain adapter 204.

Figure 8B:
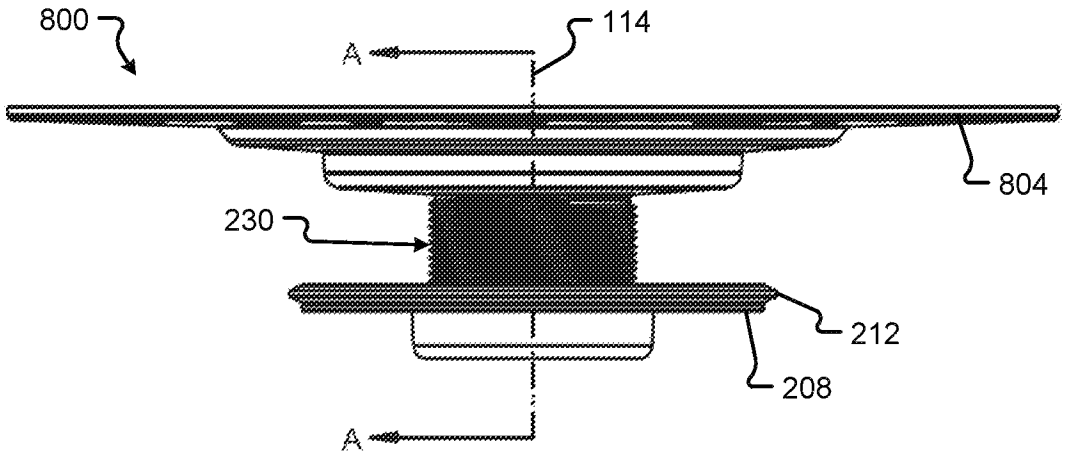
FIG. 8B is an elevation view of a low-profile drain system in accordance with embodiments of the present disclosure.
Figure 8C:
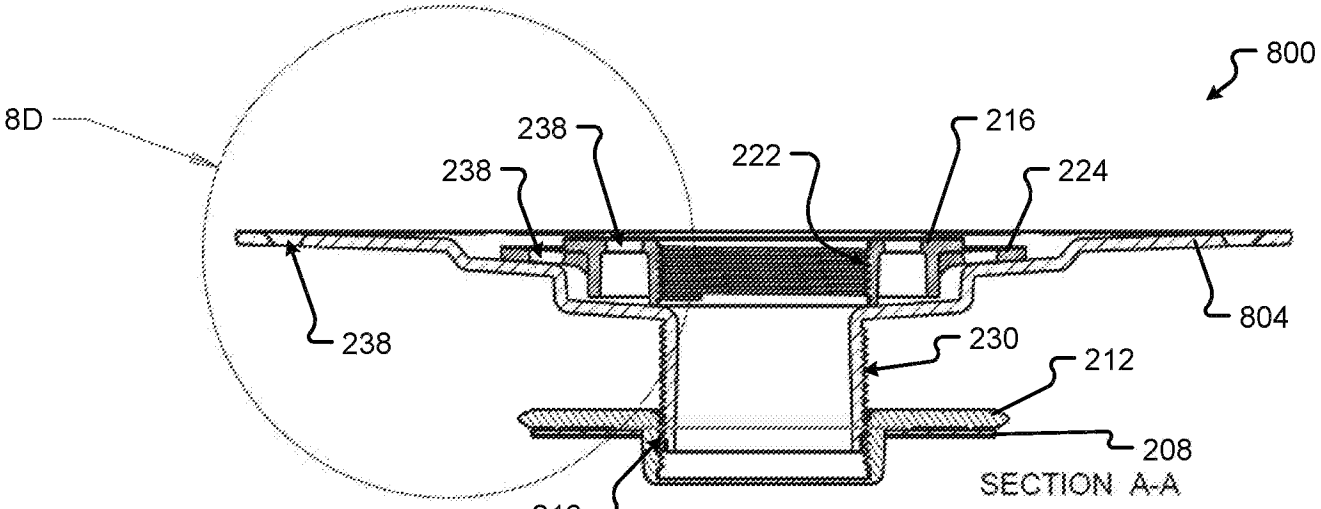
FIG. 8C is an elevation section view taken through line A-A of FIG. 8B.
Figure 8D:
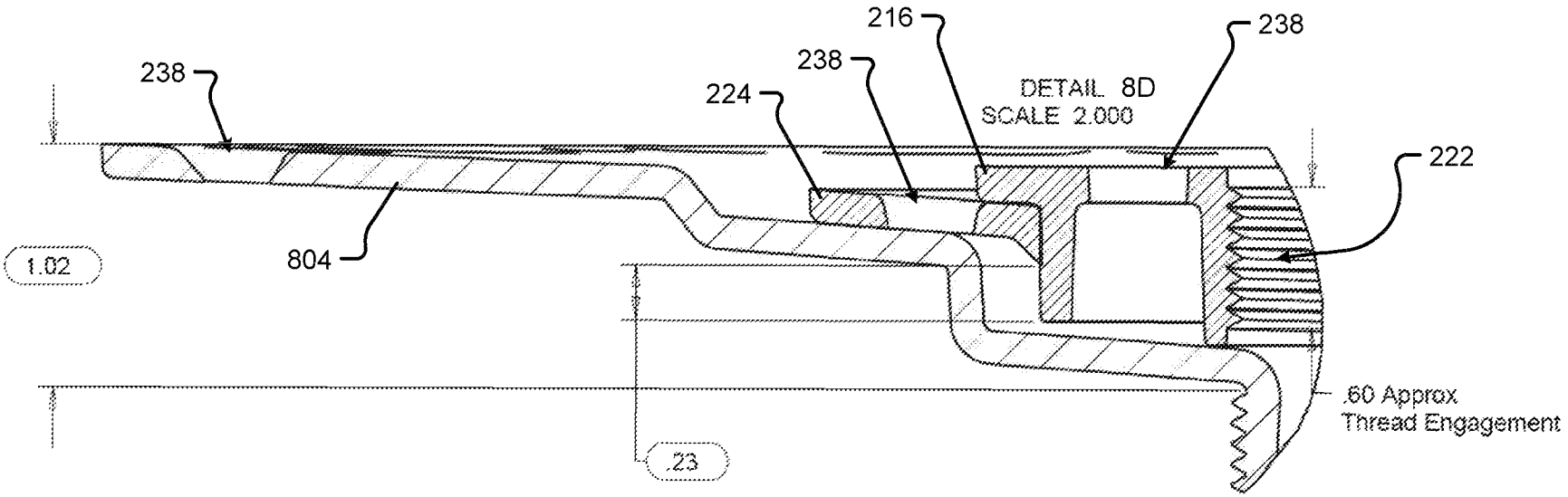
FIG. 8D is a detail elevation section view of section 8D of FIG. 8C.

FIG. 8B is an elevation view of a low-profile drain system 800, at least partially assembled, in accordance with embodiments of the present disclosure. FIG. 8C is an elevation section view taken through line A-A of FIG. 8B. FIG. 8D shows example dimensions of the low-profile drain system 800, in the at least partially assembled state, in inches. As shown in FIG. 8D, the insert engagement features 222 of the drain insert 216 are disposed inside the low-profile drain adapter 804 and below an upper portion of the low-profile drain adapter 204. This arrangement, among other things, disposes the drain insert 216 below the tile 216 and/or the tile line of the low-profile drain system 200 and provides a low-profile assembly.

Figure 9:
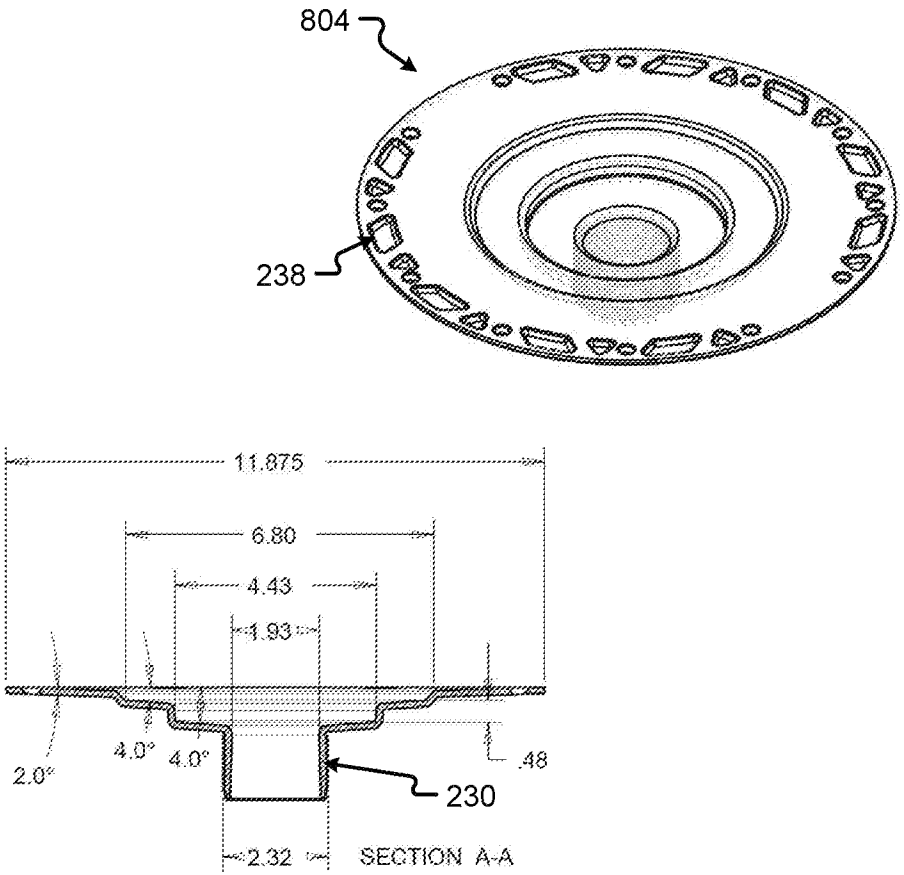
FIG. 9 shows multiple views of a low-profile drain adapter of low-profile drain system in accordance with embodiments of the present disclosure.
Figure 9:
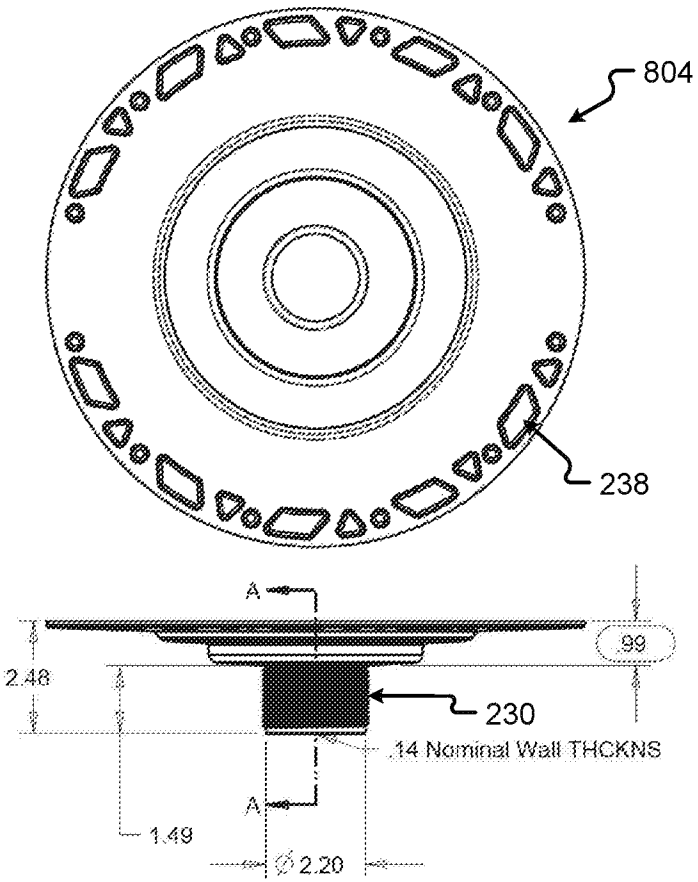

FIG. 9 shows multiple views of a low-profile drain adapter 804 of low-profile drain system 800 in accordance with embodiments of the present disclosure. In particular, FIG. 9 shows a plan view of the low-profile drain adapter 804, an elevation view of the low-profile drain adapter 804 (disposed under the plan view), an elevation section view of the low-profile drain adapter 804, and a perspective view of the low-profile drain adapter 804 in accordance with embodiments of the present disclosure. The low-profile drain adapter 804 of FIGS. 8A-9 may be substantially similar to the low-profile drain system 200 described in conjunction with FIGS. 2-4. In some embodiments, the height or shape of portions of the low-profile drain adapter 804 may be different (shorter or configured to provide a shorter height) from the low-profile drain adapter 204 of FIGS. 2-4.

Figure 10:
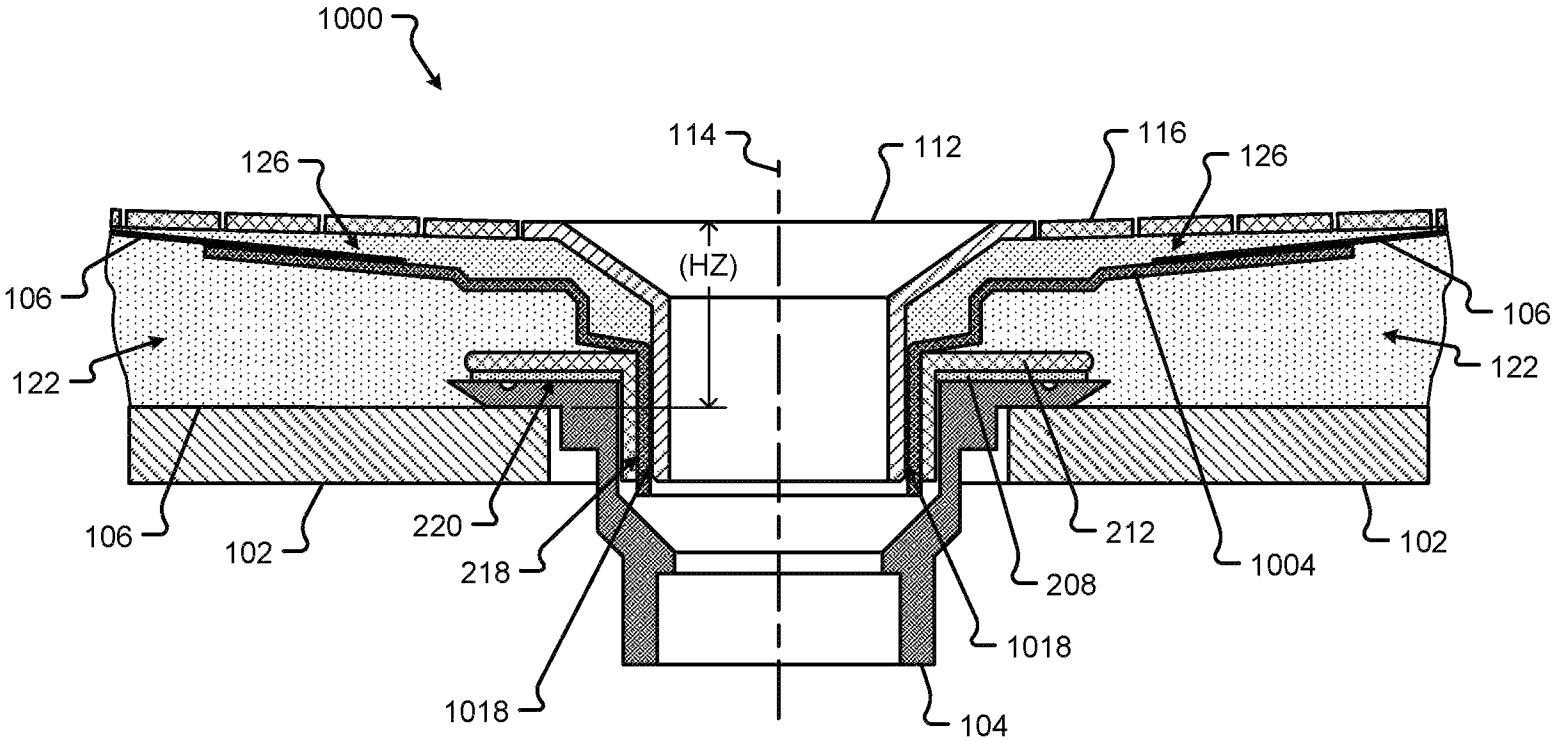
FIG. 10 is a section view of a low-profile drain system in a tiled environment in accordance with embodiments of the present disclosure.

FIG. 10 is a section view of a low-profile drain system 1000 in a tiled environment in accordance with embodiments of the present disclosure. The low-profile drain system 1000 shown in FIG. 10 is a schematic representation of the low-profile drain system 1000. The various components described in conjunction with FIG. 10 may correspond to one or more of the components as previously described in conjunction with FIGS. 1-9. For instance, the low-profile drain adapter 1004 may include similar, if not identical, features as the low-profile drain adapter 204, 804 described above. In some embodiments, the low-profile drain adapter 1004 may include an internally threaded portion configured to threadedly-engage with a head, or other drain, adapter 112. As shown in FIG. 10, the head adapter 112 is shown screwed into, or threadedly-engaged with, the low-profile drain adapter 1004 via a threaded engagement 1018 region. The low-profile drain adapter 1004 may include a drain base mounting feature 230 having a number of threads formed in an outer diameter of a tube portion of the adapter 1004 and a number of threads formed in an inner diameter of the tube portion of the adapter 1004. Although shown as directly formed on the outer and inner diameters of the tube portion of the low-profile drain adapter 1004, the threads disposed on the inner diameter of the tube portion of the low-profile drain adapter 1004 may be formed in an insert that is attached to the adapter 1004. For instance, the insert having internal threads may be bonded, adhered, welded, or otherwise affixed/sealed to the inside diameter of the tube portion of the low-profile drain adapter 1004.

Among other things, providing a direct threaded engagement 1018 region between the head adapter 112 and the low-profile drain adapter 1004, allows for an overall height of the tile 116 relative to the subfloor 102, e.g., height (HZ) that can be lower (e.g., shorter in height) than any of the previous embodiments. The height (HZ) may be defined by an adjustment of the head adapter 112 relative to the subfloor 102 by threading the head adapter 112 further into or out of the threaded low-profile drain adapter 1004 tube portion.

FIGS. 11A-16 describe various embodiments of a low-profile drain system 1100 in accordance with embodiments of the present disclosure. The low-profile drain system 1100 may include a dry-seal system comprising a threaded plate 1112 and threaded plate gasket 208 attached to the drain base 104. When attached, the dry-seal system prevents fluid, or vapor, from passing through the threaded plate gasket 208 and the threaded plate 1112 at the sealed interface.

Figure 11A:
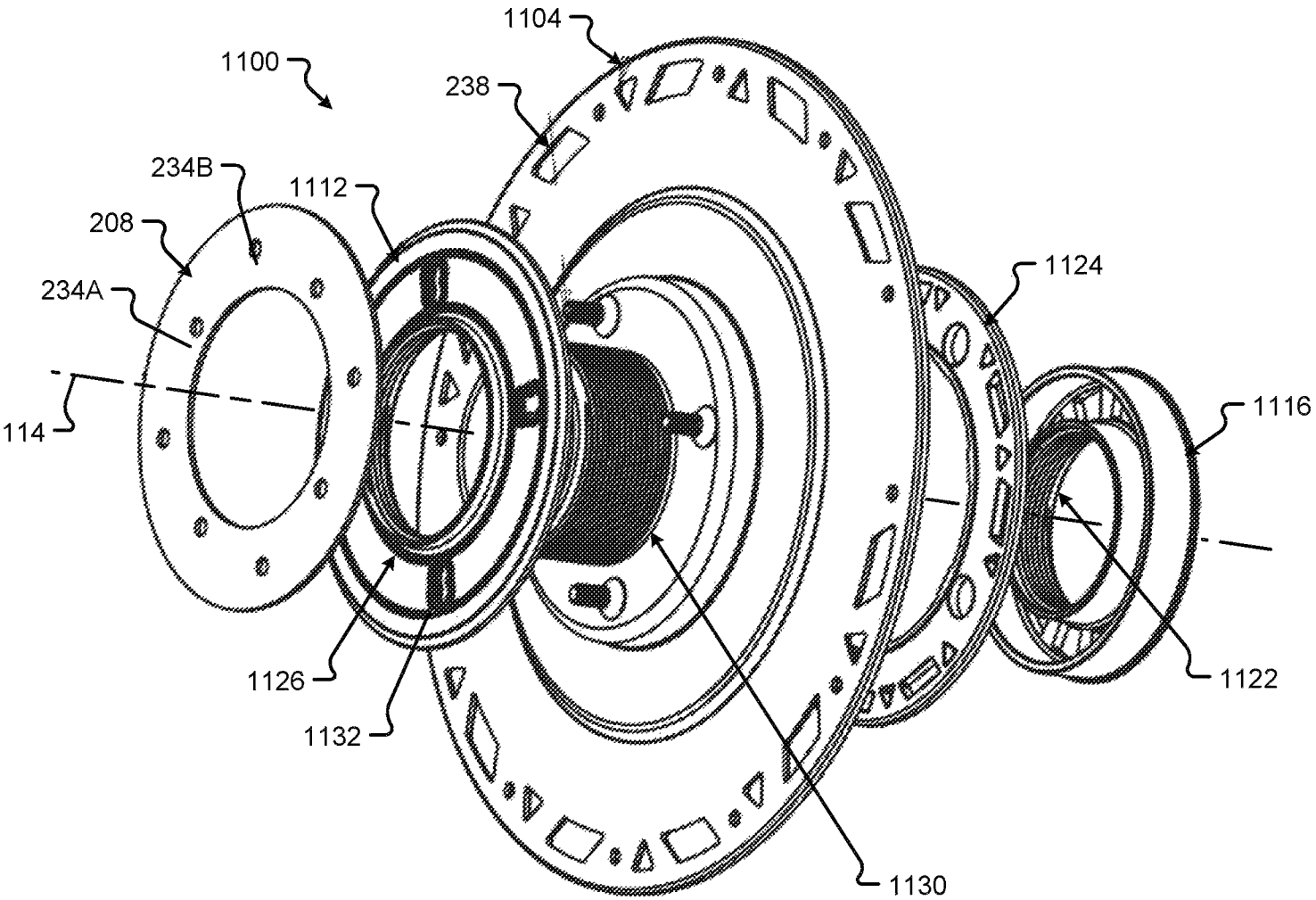
FIG. 11A is an exploded perspective view of a low-profile drain system in accordance with embodiments of the present disclosure.
Figure 11B:
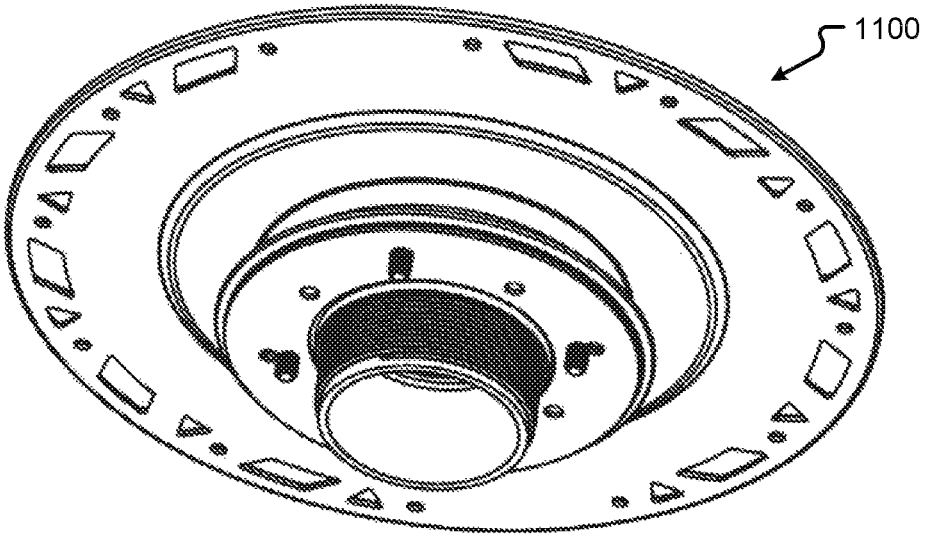
FIG. 11B is a perspective view of the low-profile drain system of FIG. 11A.
Figure 11C:
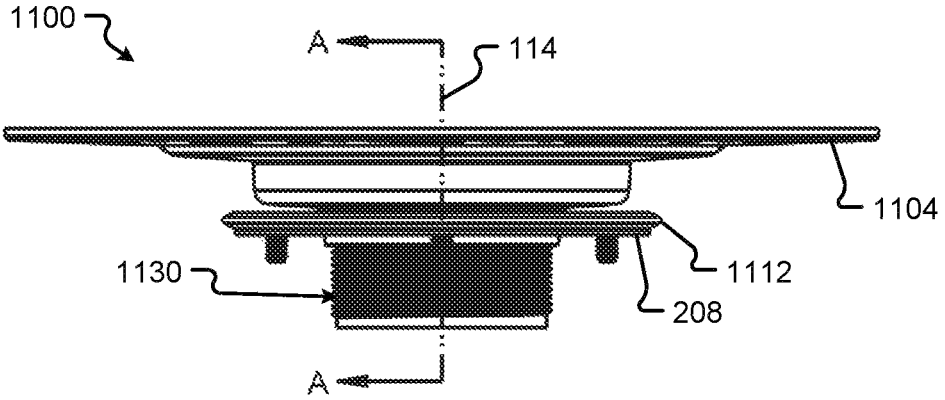
FIG. 11C is an elevation view of a low-profile drain system in accordance with embodiments of the present disclosure.

Referring to FIG. 11A, an exploded perspective view of a low-profile drain system 1100 is shown in accordance with embodiments of the present disclosure. The low-profile drain system 1100 in FIG. 11A, shows the various components (e.g., the threaded plate gasket 208, threaded plate 1112, low-profile drain adapter 1104, drain insert 1116, and the adjustable flange 1124) exploded along the drain center axis 114.

Figure 11D:
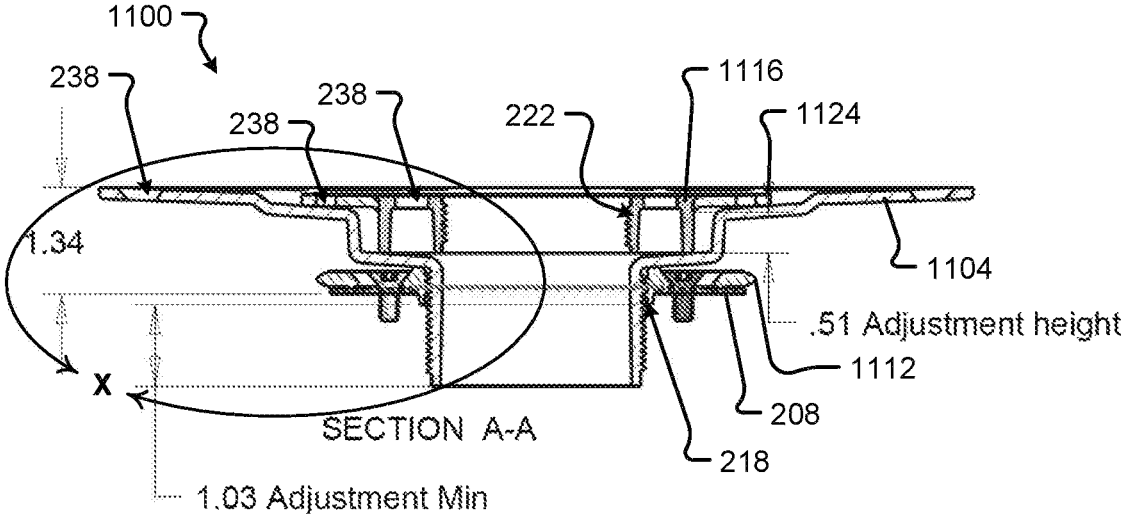
FIG. 11D is an elevation section view taken through line A-A of FIG. 11C.

The low-profile drain adapter 1104 of FIG. 11A shows a flush-mount system including flat head screws and countersunk receiving features in the threaded plate 1112. This flush-mount (e.g., low profile mount system, etc.) is illustrated in greater detail with regard to FIG. 11D. As shown in FIG. 11D, the low-profile drain adapter 1104 is able to be mounted flush with the threaded plate 112, at least at a perimeter of the threaded portion of the low-profile drain adapter 1104 tube portion. The mount screws are shown in FIG. 11D as being countersunk in the threaded plate 1112 providing the clearance for the flush mounted low-profile drain adapter 1104 show, at least, in FIGS. 11C and 11D. It is an aspect of the present disclosure that the flush-mount system described in conjunction with FIGS. 11A-16 may be used with any of the low-profile drain adapters 204, 804, 1004, 1104 described herein.

Figure 11E:
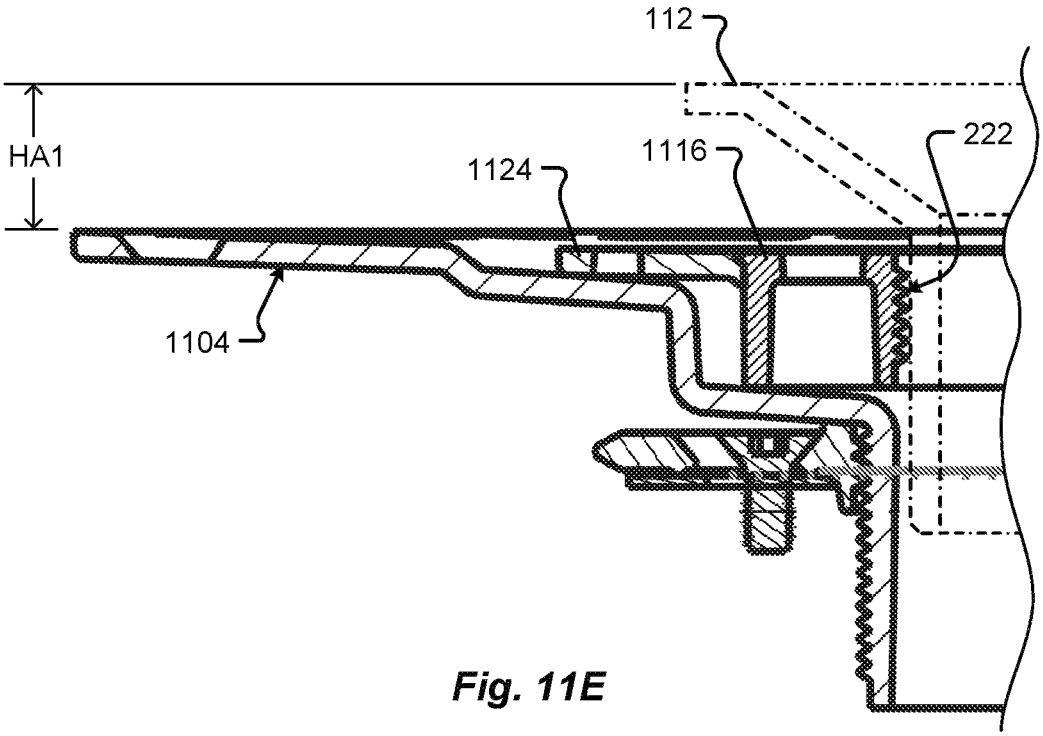
FIG. 11E is a detail elevation section view of a first embodiment of a drain insert taken from section X of FIG. 11D.

In some embodiments, the drain insert 1116 may be similar, if not identical, to the construction and design as described in conjunction with FIGS. 2-9. A first embodiment of the drain insert 1116 is shown in FIG. 11E. As shown in FIG. 11E, a drain or head adapter 112 (shown in phantom lines) may be threaded into the insert engagement features 222 of the drain insert 1116 (e.g., providing an adapter for a drain cap, filter, strainer, etc.). In the first embodiment of the drain insert 1116, the insert engagement features 222 may include a threaded region that is substantially formed along a height of the drain insert 1116. In this configuration of the drain insert 1116, the head adapter 112, when fully engaged may project a first height or distance, HAL above the low-profile drain adapter 1104.

Figure 11F:
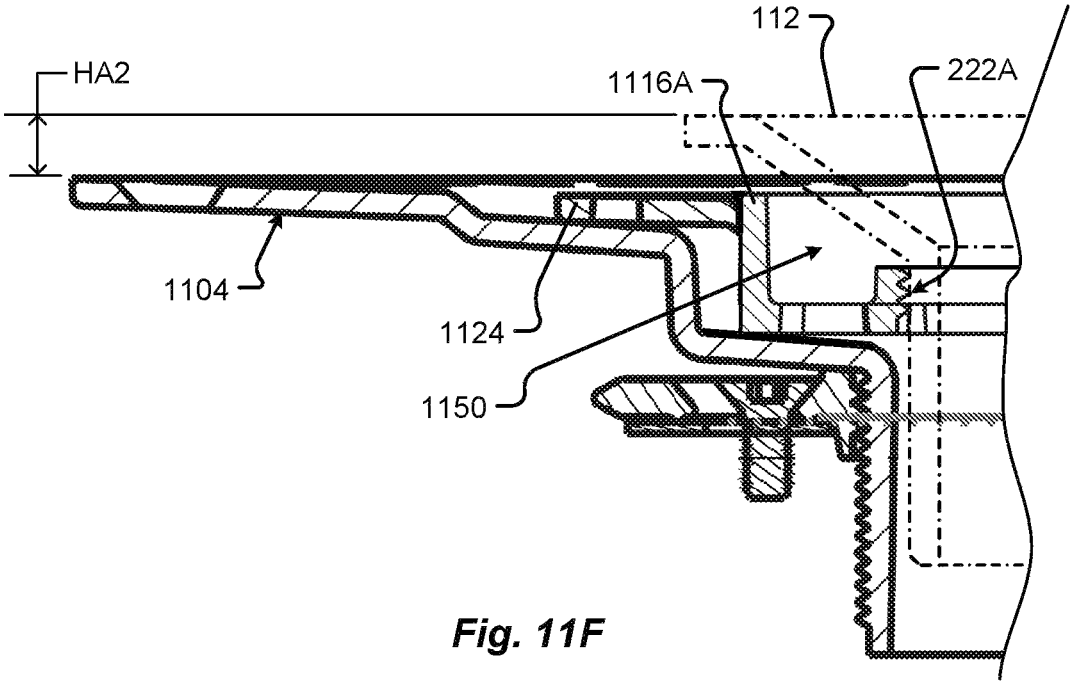
FIG. 11F is a detail elevation section view of a second embodiment of a drain insert taken from section X of FIG. 11D.

A second embodiment of the drain insert 1116A is shown in FIG. 11F, where the insert engagement features 222A are only formed along portion of the height of the drain insert 1116A. In the second embodiment of the drain insert 1116A, the internal threaded region is a fraction (e.g., half, or less than half, of the height of the drain insert 1116A. Additionally or alternatively, the threaded region of the drain insert 1116A is offset from an upper surface of the drain insert 1116A, providing a relief area 1150 for receiving a portion of a head adapter 112 or other adapter that is threadedly-engaged with the insert engagement features 222A. As shown in FIGS. 11E-11H, the head adapter 112 may include a tapered, curved, or other sloped surface having a larger diameter than the internal thread diameter of the insert engagement features 222A. As such, the head adapter 112 cannot be adjusted further than the threads at the point the taper begins. Accordingly, the embodiments of the present disclosure describe various embodiments of the drain insert 1116, 1116A-C, that provide a relief area 1150 to receive and/or conform with the head adapter 112 while simultaneously arranging the threaded region of the insert engagement features 222A at a point inside geometry of the drain insert 1116A-C and offset from an upper surface of the drain insert 1116A-C.

Figure 11G:
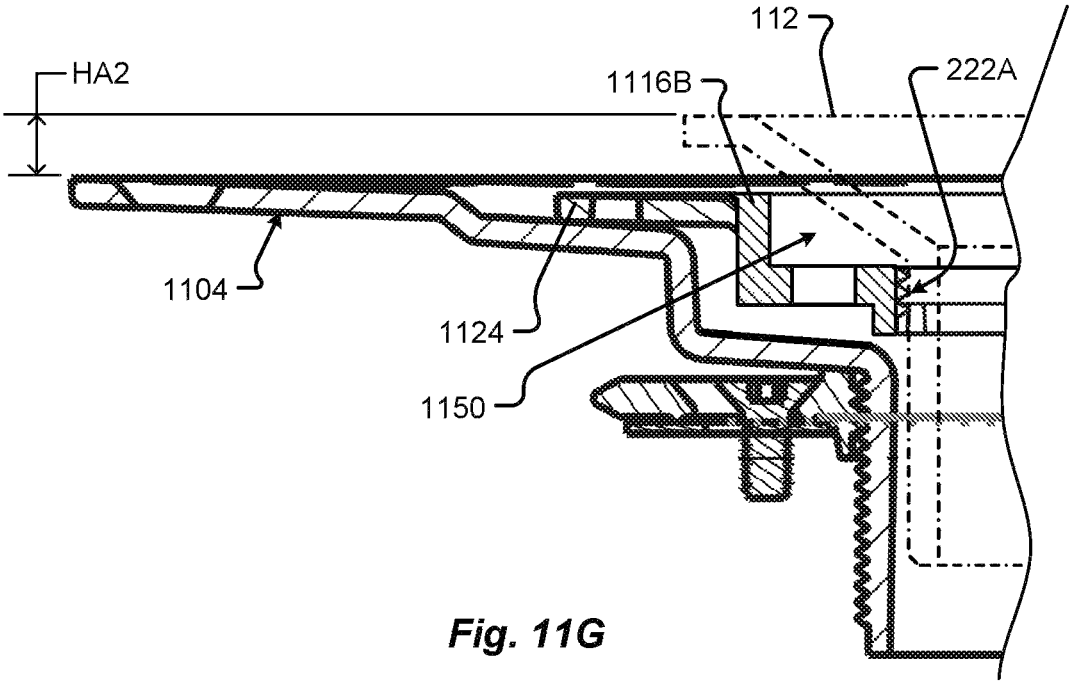
FIG. 11G is a detail elevation section view of a third embodiment of a drain insert taken from section X of FIG. 11D.
Figure 11H:
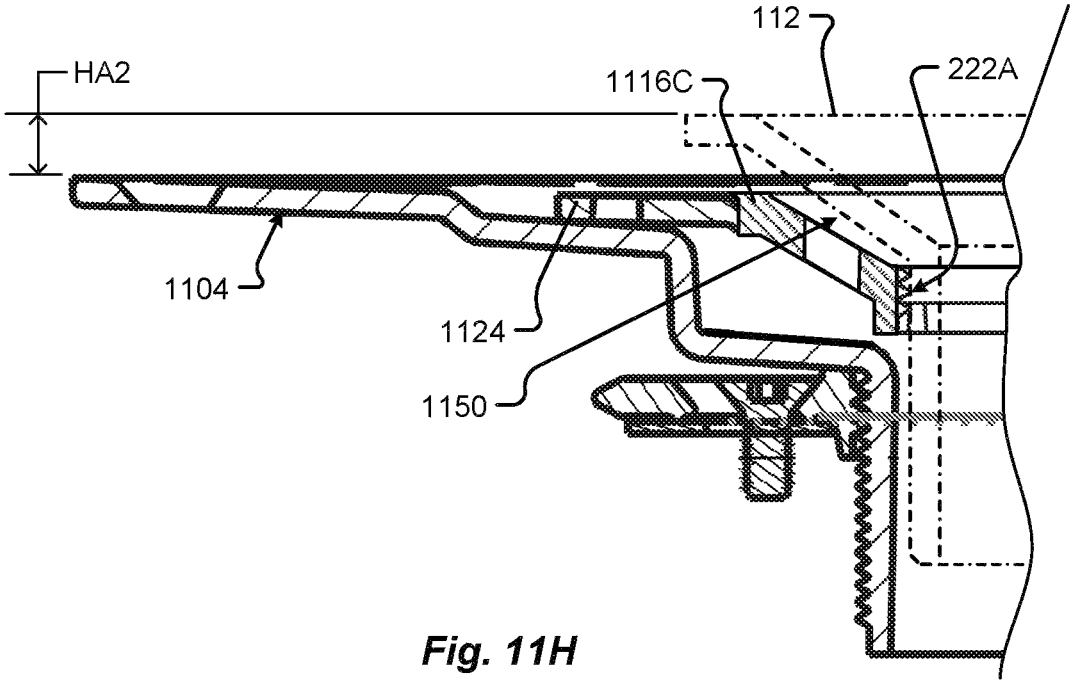
FIG. 11H is a detail elevation section view of a fourth embodiment of a drain insert taken from section X of FIG. 11D.

The embodiments of the drain insert 1116A-C all include an offset set of internal threads comprising the insert engagement features 222A disposed inside the geometry of the drain insert 1116A-C, such that the head adapter 112 may be engaged with the drain insert 1116A-C producing a lower overall height, HA2, for the head adapter 112 as measured from the low-profile drain adapter 1104 (e.g., compared to the first height or distance, HA1). In particular, FIG. 11F shows an embodiment of the drain insert 1116A having the threaded portion spanning half, or less than half, of the height of the drain insert 1116A, and the connection portion (e.g., the portion of material in the drain insert 1116A connecting the outer diameter to the threaded portion, etc.) disposed on a lower surface of the drain insert 1116A. FIG. 11G shows an embodiment of the drain insert 1116B having the threaded portion spanning half, or less than half, of the height of the drain insert 1116B, and the connection portion disposed at about a middle of the height of the drain insert 1116B. FIG. 11H shows an embodiment of the drain insert 1116C having the threaded portion spanning half, or less than half, of the height of the drain insert 1116C, and a tapered connection portion following, or substantially following, a taper and/or geometry of the mating head adapter 112.

Figure 12:
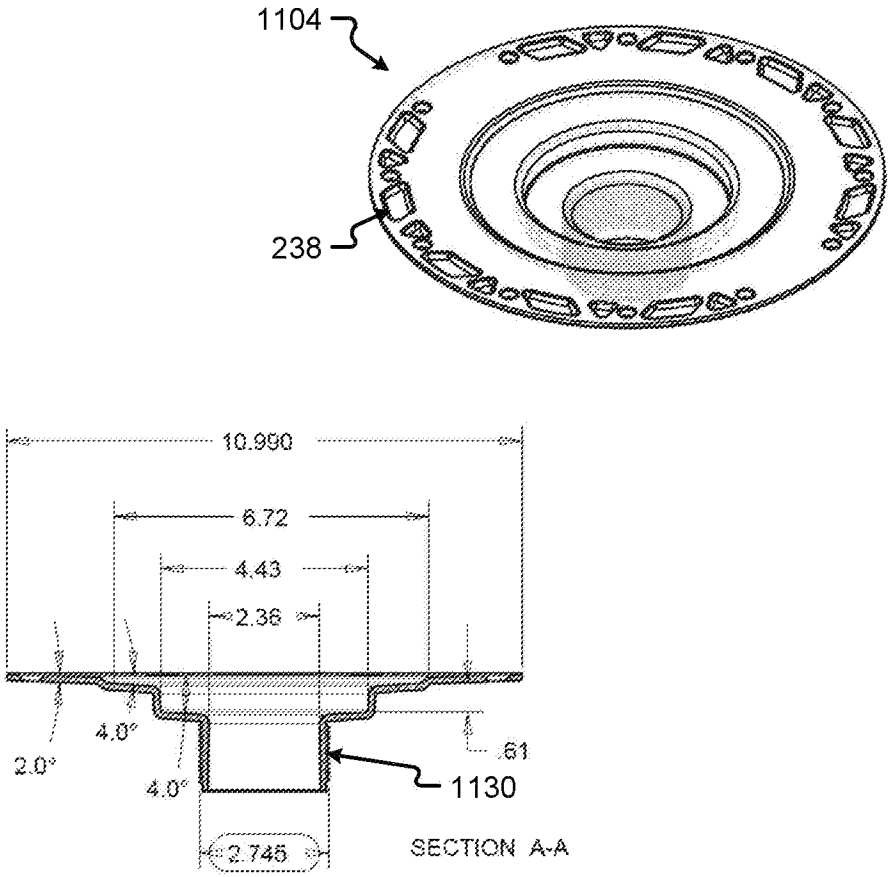
FIG. 12 shows multiple views of a low-profile drain adapter of low-profile drain system in accordance with embodiments of the present disclosure.
Figure 12:
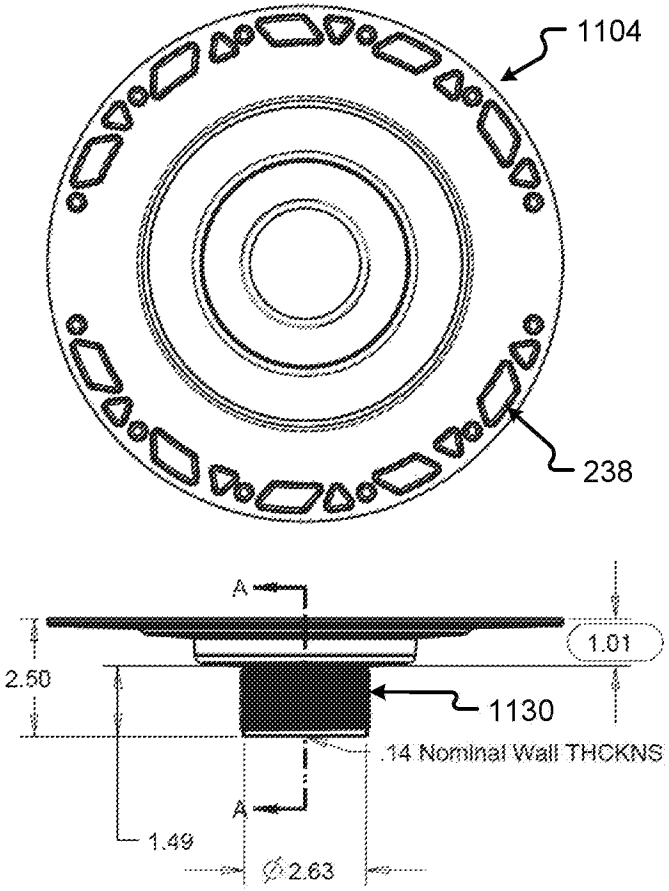
Figure 13:
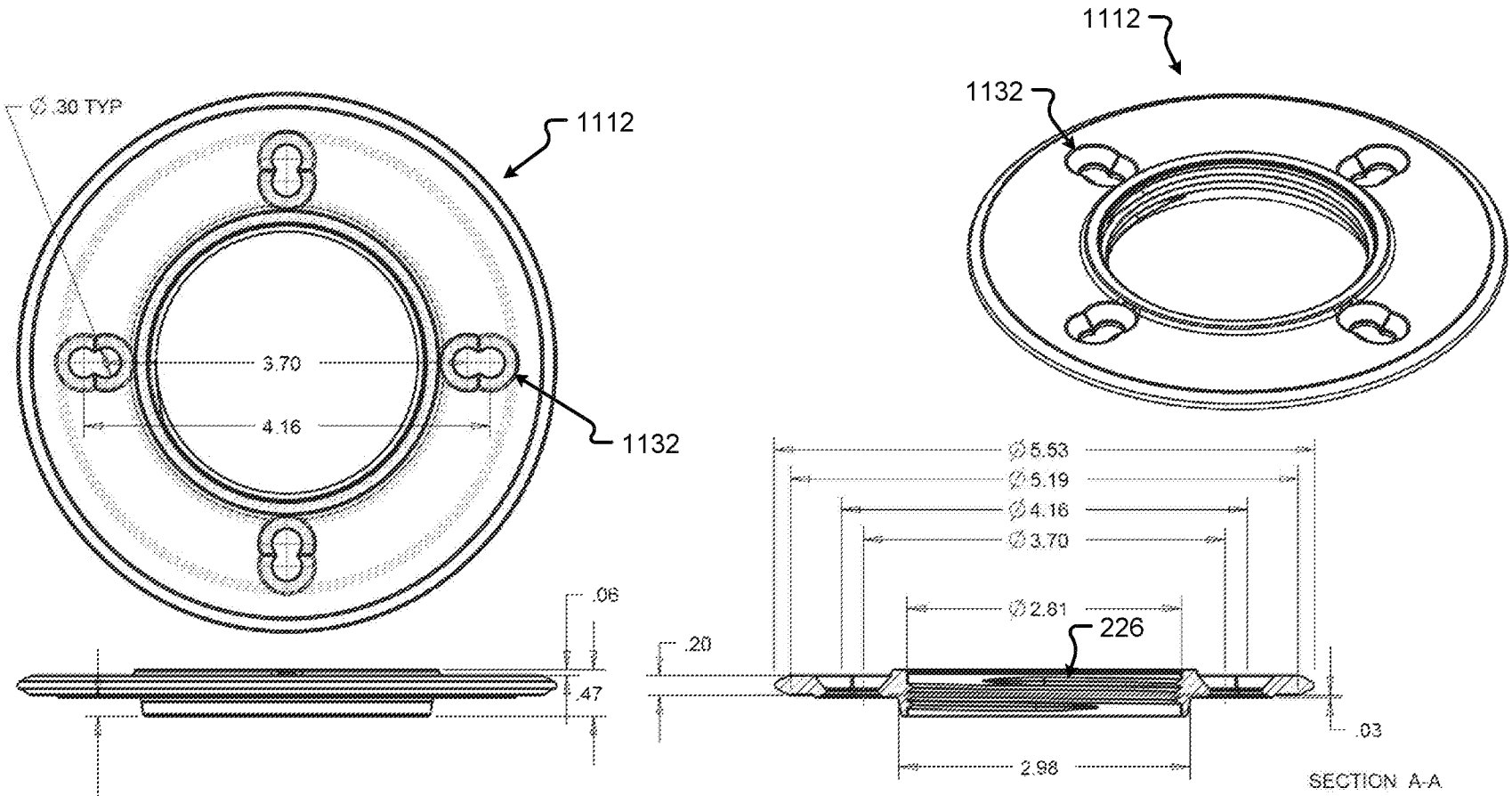
FIG. 13 shows multiple views of a threaded plate of a low-profile drain system in accordance with embodiments of the present disclosure.
Figure 14:
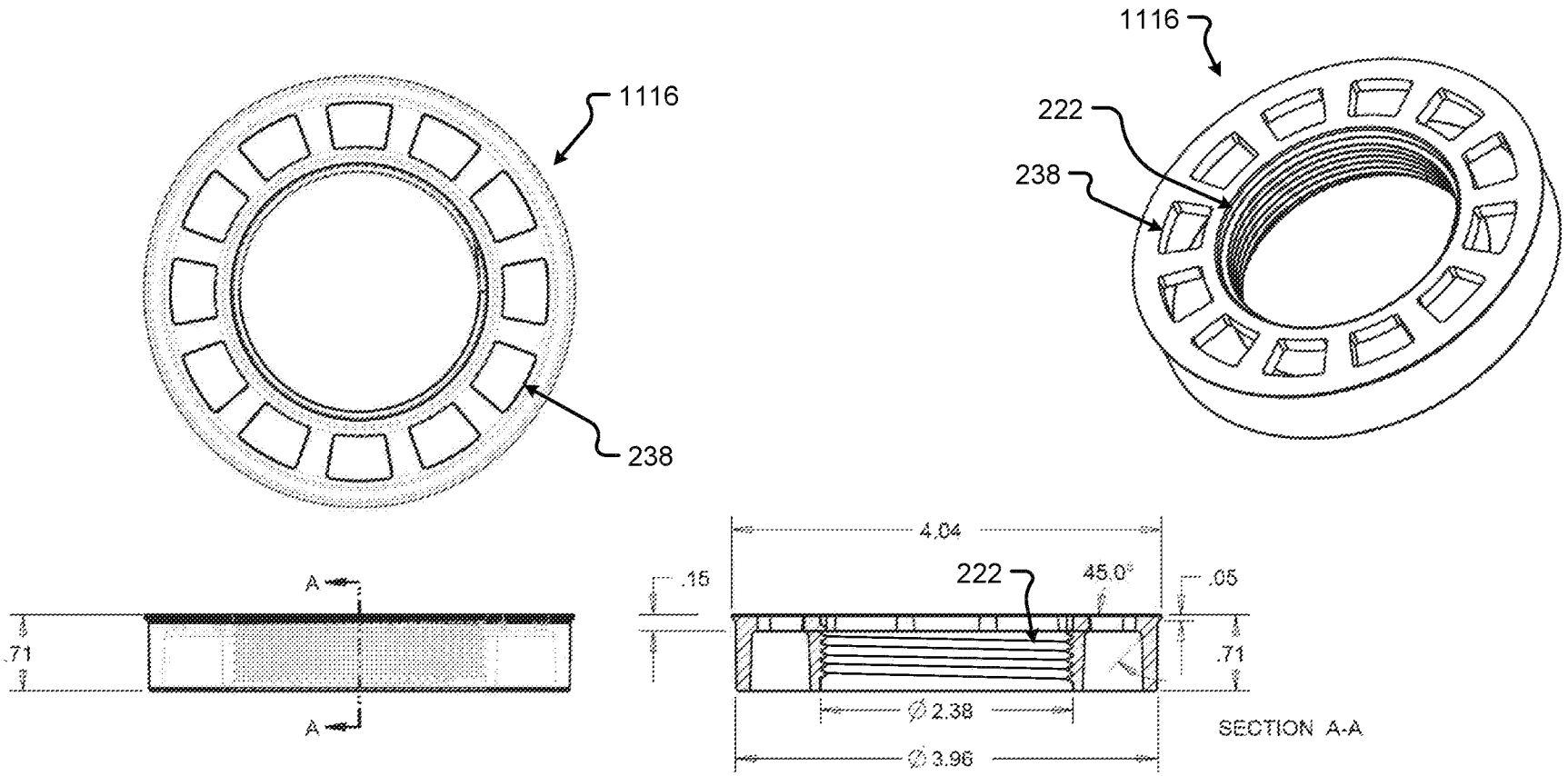
FIG. 14 shows multiple views of a drain insert of a low-profile drain system in accordance with embodiments of the present disclosure.
Figure 15:
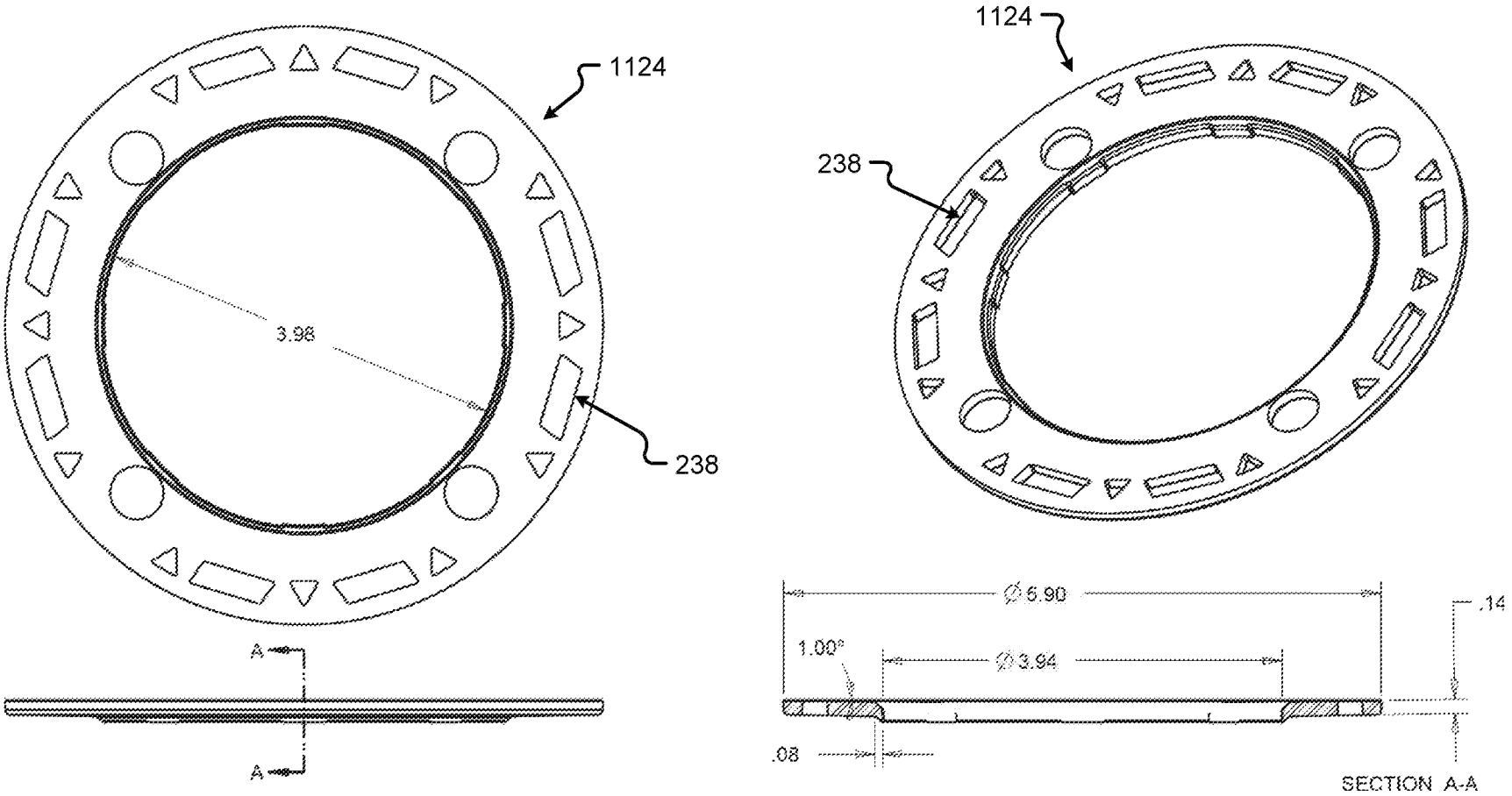
FIG. 15 shows multiple views of an adjustable flange of a low-profile drain system in accordance with embodiments of the present disclosure.
Figure 16:
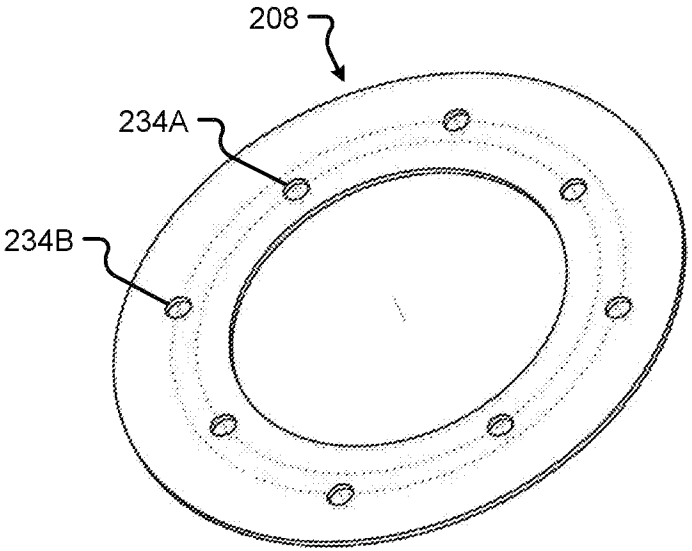
FIG. 16 shows multiple views of threaded plate gasket of a low-profile drain system in accordance with embodiments of the present disclosure.
Figure 16:
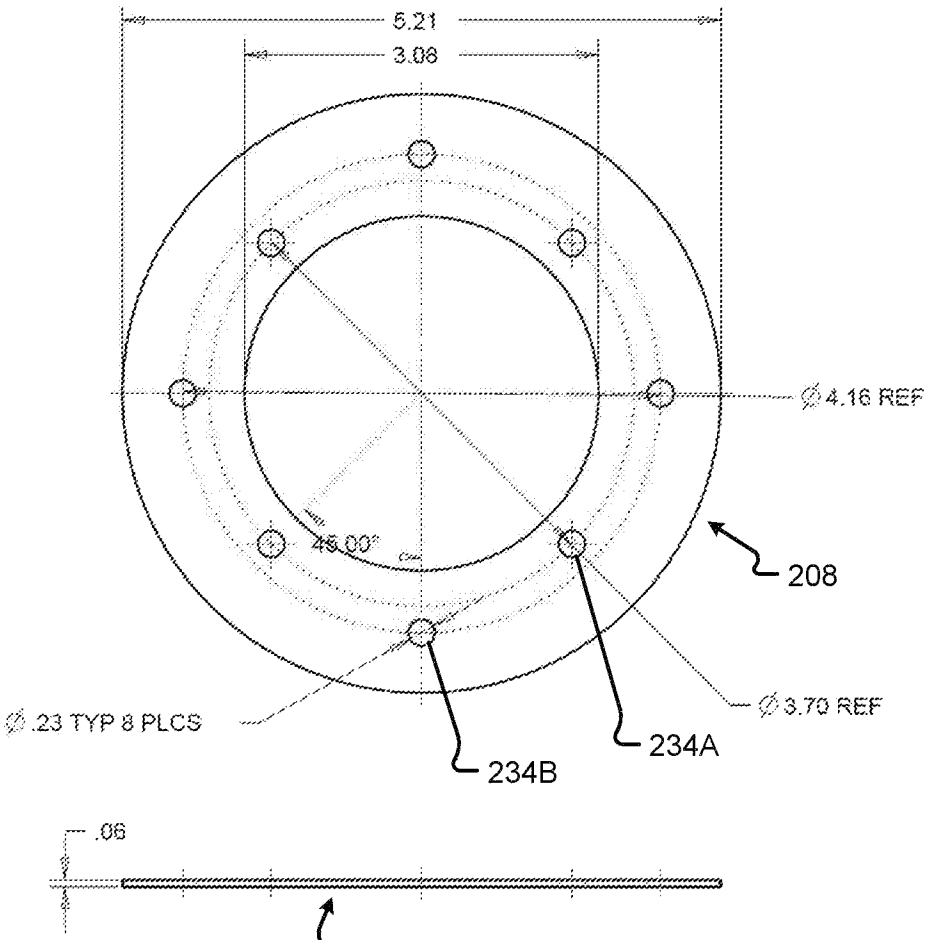

FIGS. 12-16 show the various components of the low-profile drain system 1100 separately, and apart, from one another. For instance, FIG. 12 shows multiple views of the low-profile drain adapter 1104. FIG. 13 shows multiple views of a threaded plate 1112 of a low-profile drain system including countersunk mount features 1132 configured to receive a flush mount fastener (e.g., a flat head screw, etc.). FIG. 14 shows multiple views of a first embodiment of a drain insert 1116 of a low-profile drain system in accordance with embodiments of the present disclosure. FIG. 15 shows multiple views of an adjustable flange that slides along the drain center axis 114 having an inner diameter that contacts an outer periphery of the drain insert 1116. FIG. 16 shows multiple views of threaded plate gasket 208 including different sets of mount features 234A, 234B arranged on separate bolt circle diameters (BCDs). As shown in FIG. 16, the threaded plate gasket 208 may be used to interface with drain bases 104 having different BCDs. For instance, the first mount features 234A (on a first BCD) may be associated with a corresponding BCD for a particular drain base 104 and the second mount features 234B (on a second BCD) may be associated with a corresponding BCD for a different type of drain base 104. As can be appreciated, the threaded plate 212, 1112 may include similarly arranged mount features 232, 1132.

FIGS. 17A-21 describe various embodiments of a low-profile drain system 1700 in accordance with embodiments of the present disclosure. The low-profile drain system 1700 may include a dry-seal system comprising a threaded plate 1712, an interface adapter 1712, a low-profile drain adapter 1704, and a drain base interface gasket 1720. The low-profile drain system 1700 may be configured to attach to a drain base 104 as described above. In some embodiments, the low-profile drain system 1700 may contact the drain base 104 at the drain base interface gasket 1720. For instance, the complete low-profile drain system 1700 may fastened to the drain base 104 by way of the interface adapter 1712. As the fasteners are tightened, the low-profile drain adapter 1704 may be brought closer to the drain base 104 compressing the drain base interface gasket 1720. This compressive fastening may provide a compliant gasket seal between the low-profile drain system 1700 and the drain base 104. Among other things, this dry-seal system provides a completely moisture sealed system that prevents any fluid, or vapor, from passing outside of the drain.

Referring to FIG. 17, an exploded perspective view of a low-profile drain system 1700 is shown in accordance with embodiments of the present disclosure. The low-profile drain system 1700 in FIG. 17A, shows the various components (e.g., the low-profile drain adapter 1704, interface adapter 1712, low-profile drain insert 1716, drain base interface gasket 1720, and the drain gate 1748) exploded along the drain center axis 114.

Figure 17A:
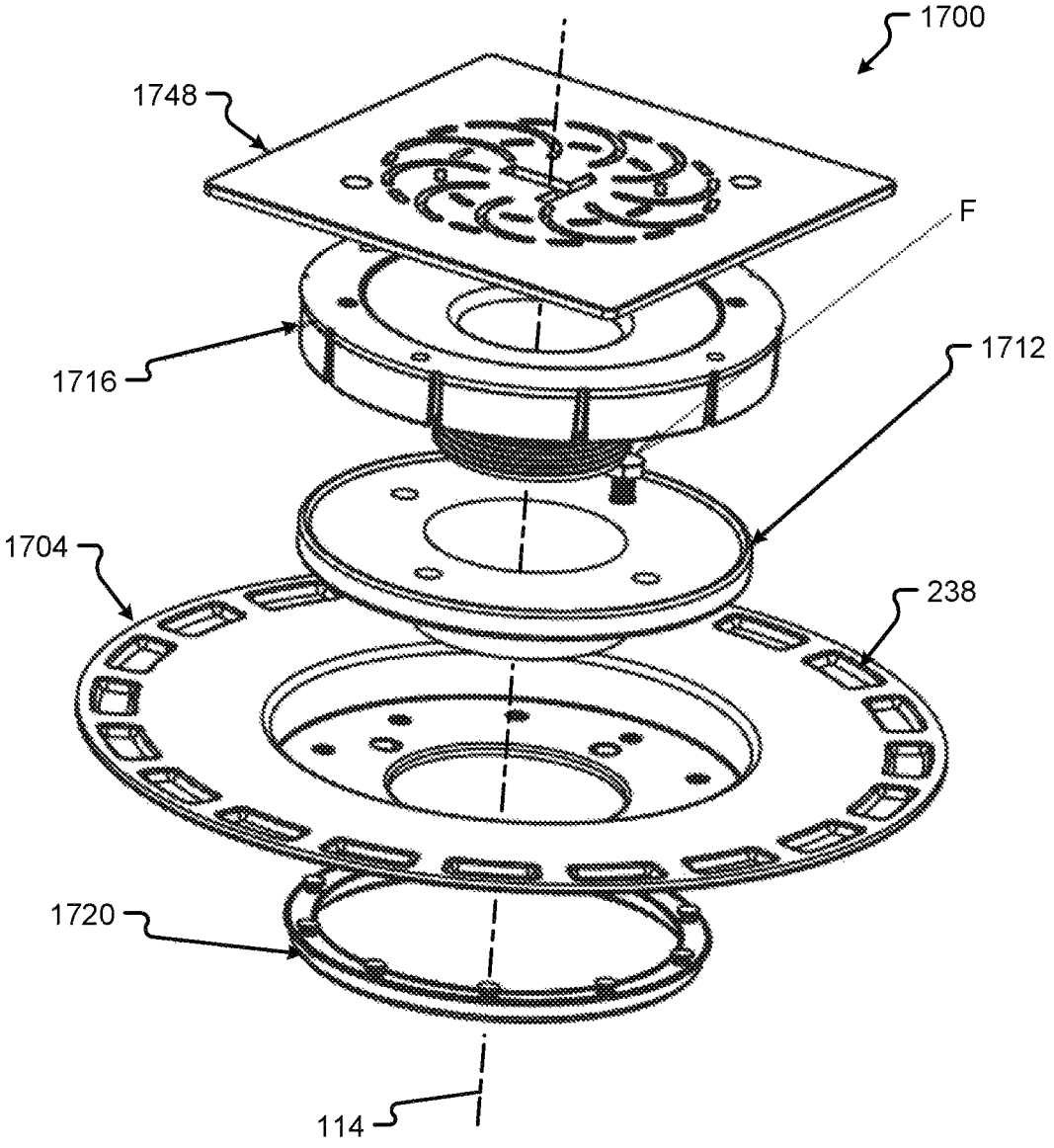
FIG. 17A is an exploded perspective view of a low-profile drain system in accordance with embodiments of the present disclosure.

The low-profile drain adapter 1704 of FIG. 17A shows a compact system including fasteners, F, that mount the interface adapter 1712 to the low-profile drain adapter 1704 and/or the drain base 104. The low-profile drain insert 1716 may threadedly engage with threads in the interface adapter 1712. In some embodiments, the low-profile drain insert 1716 may include a number of peripheral weep grooves 1740. These peripheral weep grooves 1740 may be disposed on an outer periphery of the low-profile drain insert 1716 between an internal diameter recessed portion of the low-profile drain adapter 1704. In this example, excess moisture, or vapor, may follow the path provided by the peripheral weep grooves 1740 to the drain. Details of this compact and low-profile mount system are shown in greater detail with respect to FIGS. 17B-E.

Figure 17B:
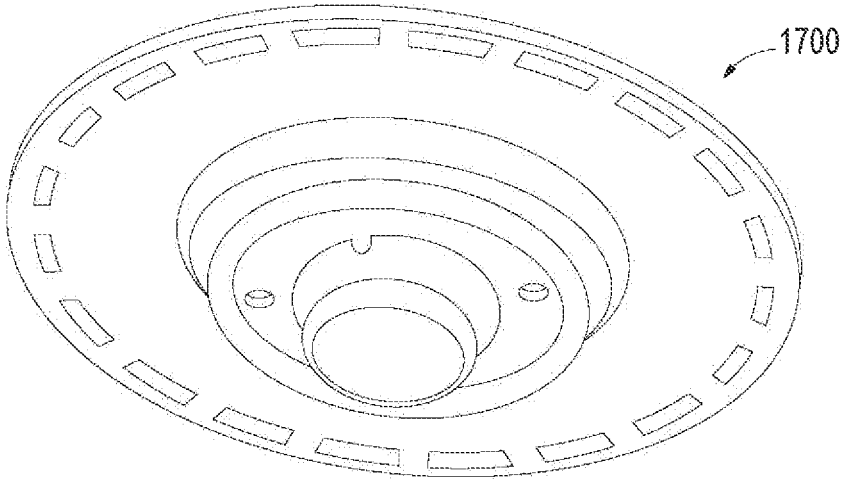
FIG. 17B is a bottom perspective view of the low-profile drain system of FIG. 17A.

FIG. 17B shows a bottom perspective view of an assembled low-profile drain system 1700 in accordance with embodiments of the present disclosure.

Figure 17C:
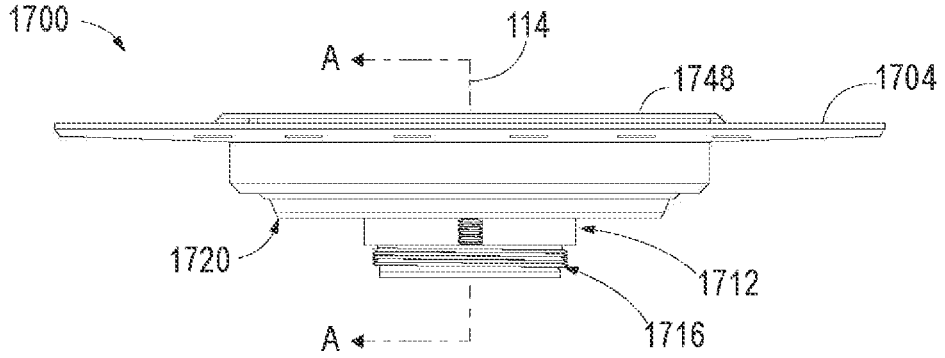
FIG. 17C is an elevation view of a low-profile drain system in accordance with embodiments of the present disclosure.

FIG. 17C shows an elevation view of the assembled low-profile drain system 1700 in accordance with embodiments of the present disclosure.

Figure 17D:
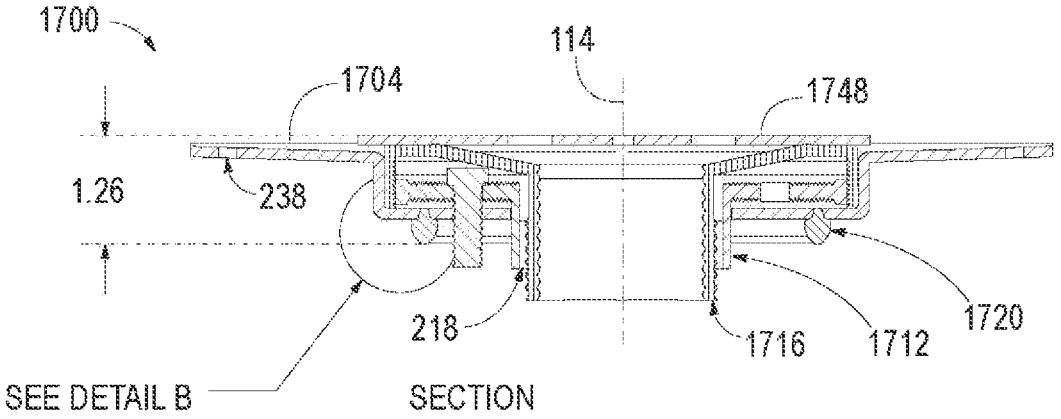
FIG. 17D is an elevation section view taken through line A-A of FIG. 17C.

FIG. 17D shows an elevation section view taken through line A-A of FIG. 17C. As shown in FIG. 17D, the components of the low-profile drain system 1700 allow the interface adapter 1712, the low-profile drain insert 1716, and the drain gate 1748 attached to the low-profile drain insert 1716 to be adjusted from a minimal height (e.g., approximately 1.26 inches, etc.) to an overall height as provided by the threaded engagement 218 between the low-profile drain insert 1716 and the interface adapter 1712. In some embodiments, the drain gate 1748 may be mounted flush, or substantially flush, with the top surface low-profile drain adapter 1704. In one embodiment, the fasteners, F, or mount screws, may be countersunk in the interface adapter 1712. In some embodiments, the fasteners, F, may be standard, or low-profile, bolts that pass through the interface adapter 1712 and the low-profile drain adapter 1704 to screw into threaded holes disposed in a drain base 104. It is an aspect of the present disclosure that the compact and low-profile mount system described in conjunction with FIGS. 17A-21 may be used with any of the low-profile drain adapters 204, 804, 1004, 1104, or other components described herein.

Figure 17E:
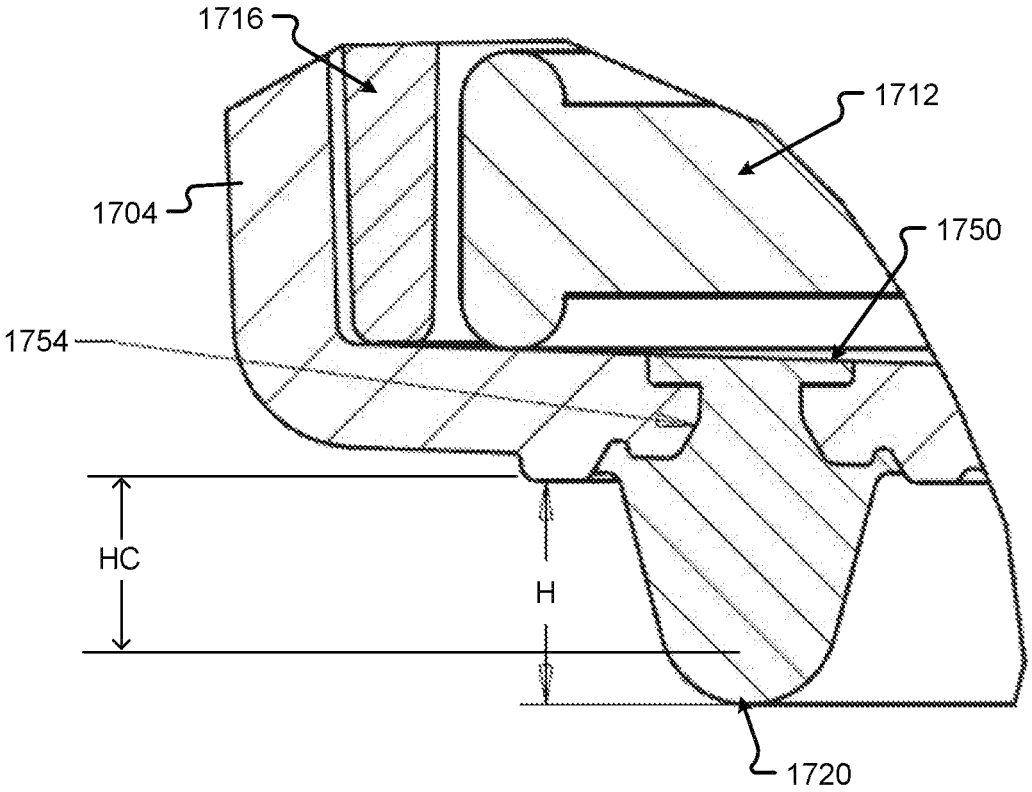
FIG. 17E is a detail elevation section view of circle B shown in FIG. 17D.

Referring to FIG. 17E, a detail elevation section view of circle B shown in FIG. 17D is shown in accordance with embodiments of the present disclosure. The detail shows a section of the drain base interface gasket 1720 disposed in the body of the low-profile drain adapter 1704. In particular, the drain base interface gasket 1720 may be insert molded, or overmolded, into one or more low-profile gasket retaining features 1754, recesses, grooves, holes, disposed in the low-profile drain adapter 1704. The drain base interface gasket 1720 may be made from silicone, RTV silicone, rubber, thermoplastic elastomer, copolymer, or other compliant, compressible, or flexible sealing material.

In some embodiments, the drain base interface gasket 1720 may include one or more gasket retaining heads 1750 that can be formed upon molding the drain base interface gasket 1720 into the low-profile drain adapter 1704. For instance, the low-profile drain adapter 1704 may comprise a series of countersunk or counterbored holes that provide a retaining feature for the drain base interface gasket 1720 when inserted and/or molded therein. In some embodiments, the low-profile gasket retaining features 1754 may include a complex path, or interrupted surface, providing a tortuous path through which water, moisture, or vapor cannot pass. Additionally or alternatively, upon being compressed when attached to a drain base 104, the drain base interface gasket 1720 may swell, or expand, within the low-profile gasket retaining features 1754, holes, etc., of the low-profile drain adapter 1704 further providing an enhanced moisture seal between a top surface of the low-profile drain adapter 1704 and a bottom surface of the low-profile drain adapter 1704.

As shown in FIG. 17E, the drain base interface gasket 1720 may have a default, or uncompressed height, H, prior to being attached to a drain base 104. The drain base interface gasket 1720 may be configured to compress to a reduced height, HC, when attached and/or fastened to a drain base 104. In some embodiments, the drain base interface gasket 1720 may compress greater than 5% of the default height, H. In one embodiment, the drain base interface gasket 1720 may be configured to compress greater than 20% of the default height, H, shown in FIG. 17E. In any event, when the drain base interface gasket 1720 is compressed, the resistive force of the gasket 1720 against the bottom surface of the low-profile drain adapter 1704 and the upper surface of the drain base 104 may provide a watertight and/or vapor-tight seal.

Figure 18:
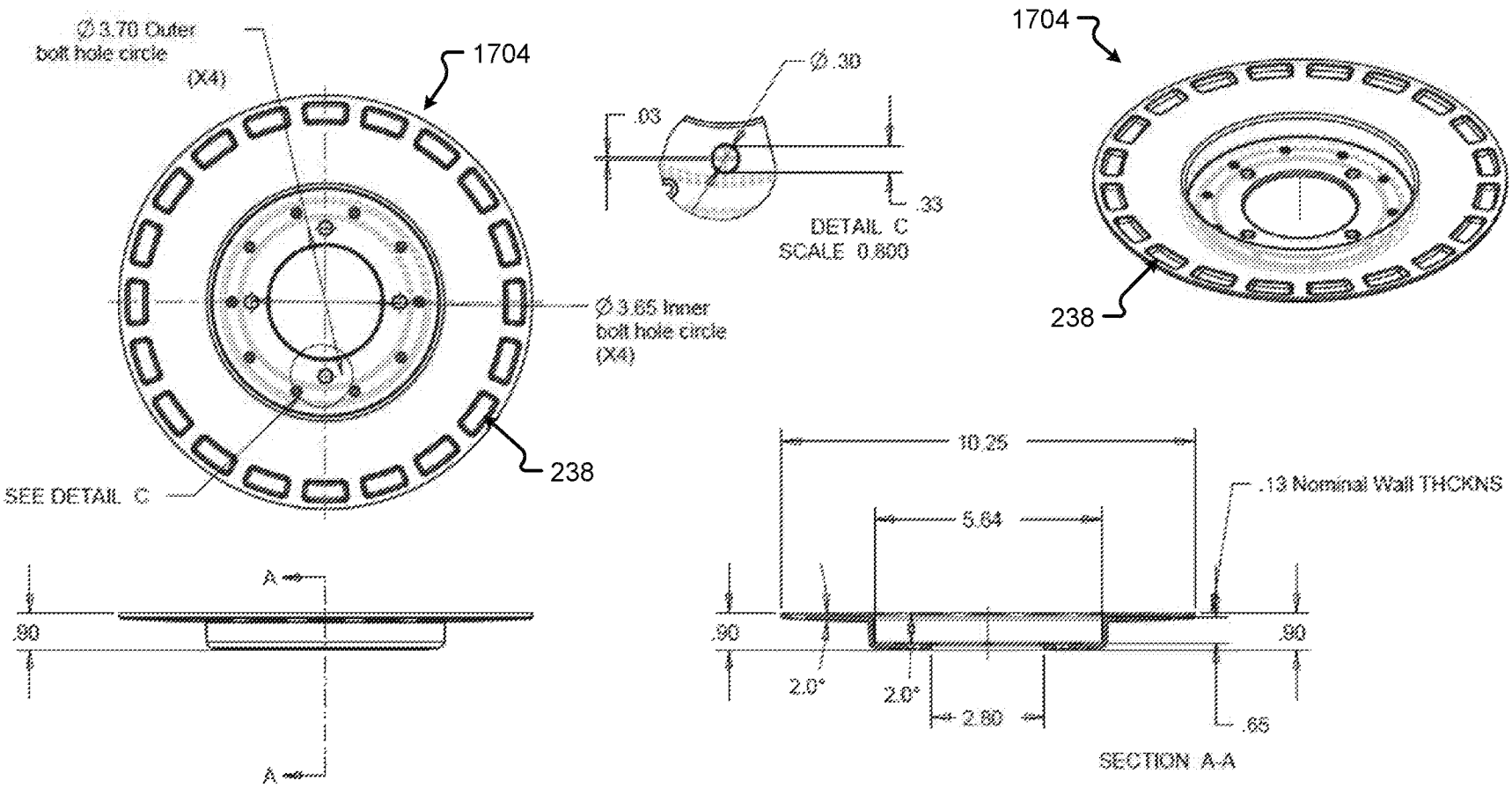
FIG. 18 shows multiple views of a low-profile drain adapter of the low-profile drain system shown in FIG. 17A.

FIGS. 18-21 show the various components of the low-profile drain system 1700 separately, and apart, from one another. For instance, FIG. 18 shows multiple views of the low-profile drain adapter 1704.

Figure 19:
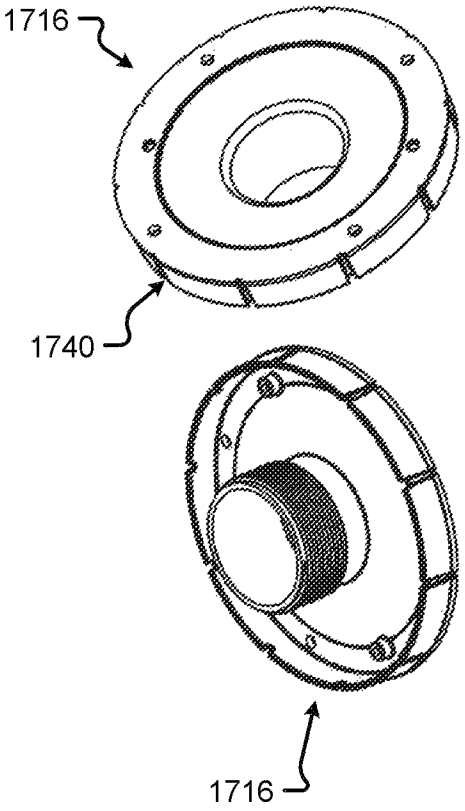
FIG. 19 shows multiple views of a low-profile drain insert of the low-profile drain system shown in FIG. 17A.
Figure 19:
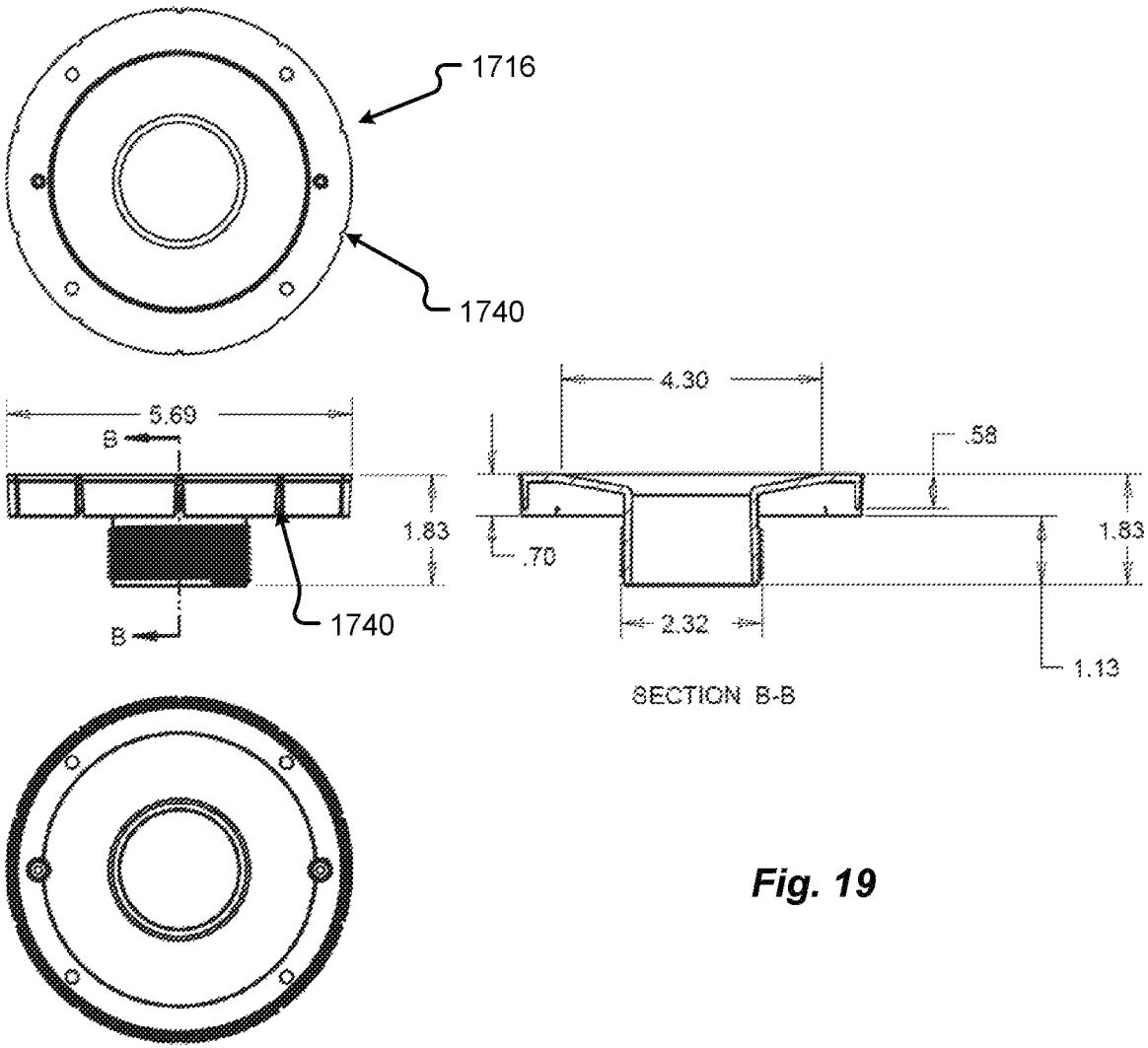

FIG. 19 shows multiple views of a low-profile drain insert 1716 of a low-profile drain system including threaded engagement features configured to thread onto an interface adapter 1712 of the low-profile drain system 1700. The low-profile drain insert 1716 may include a number of peripheral weep grooves 1740 disposed around a periphery of the low-profile drain insert 1716 body. As described above, the peripheral weep grooves 1740 may provide a weep path for moisture and/or vapor to the drain (e.g., which the low-profile drain system 1700 is attached). The peripheral weep grooves 1740 may include a cutout section at a point where the low-profile drain insert 1716 may contact a portion of the low-profile drain adapter 1704. This cutout may ensure that moisture and/or vapor is allowed to channel through to the drain after installation.

Figure 20:
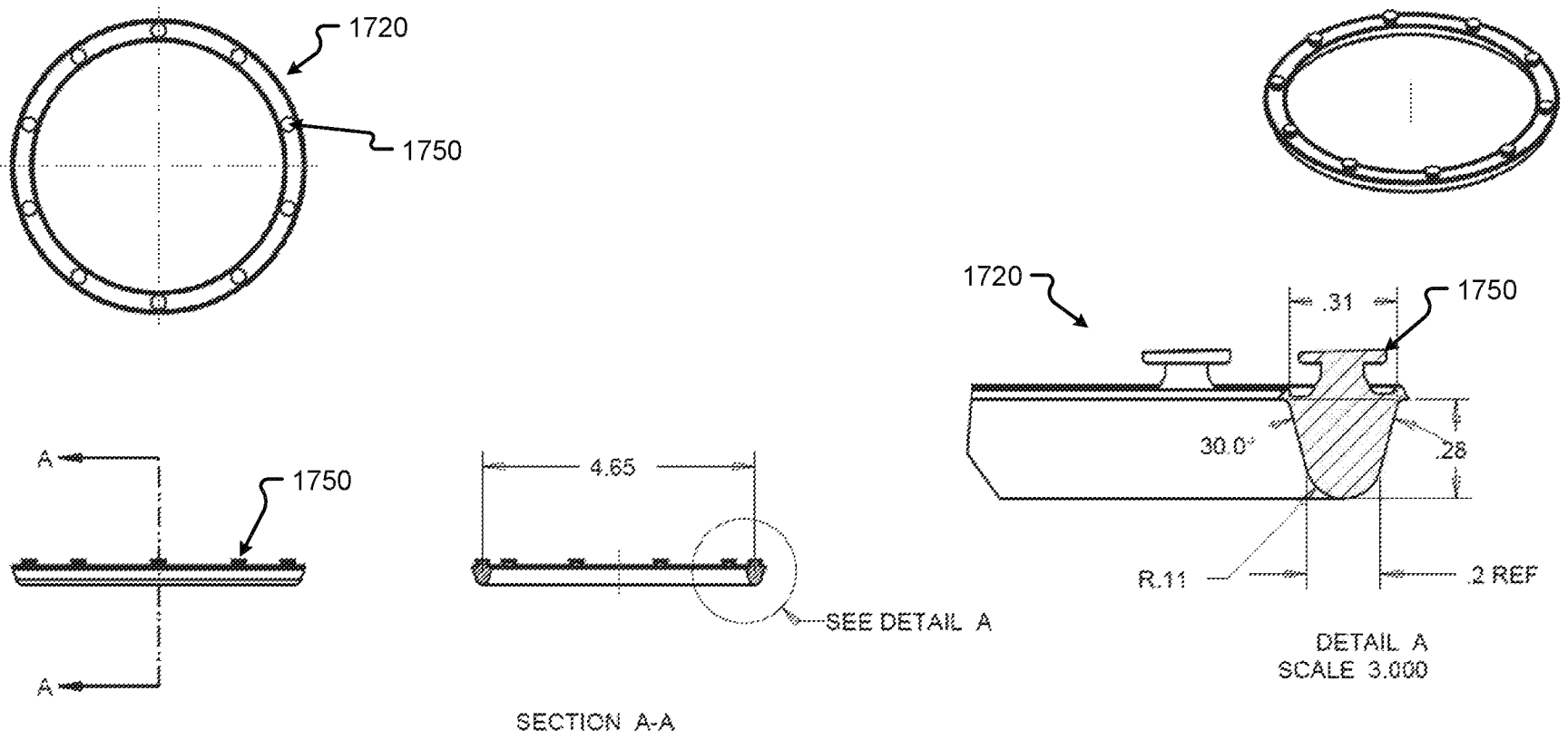
FIG. 20 shows multiple views of a drain base interface gasket of the low-profile drain system shown in FIG. 17A.

FIG. 20 shows multiple views of a drain base interface gasket 1720 in accordance with embodiments of the present disclosure. Although described as being overmolded, or molded into, the body of the low-profile drain adapter 1704, the embodiments described herein are not so limited. For instance, the drain base interface gasket 1720 may be separately molded and inserted into the low-profile gasket retaining features 1754 of the low-profile drain adapter 1704. In any event, the drain base interface gasket 1720 may be made from a compliant compressible material that is configured to provide a seal between the low-profile drain adapter 1704 and the drain base 104. In some embodiments, the drain base interface gasket 1720 may be elastically deformable or compressible.

Figure 21:
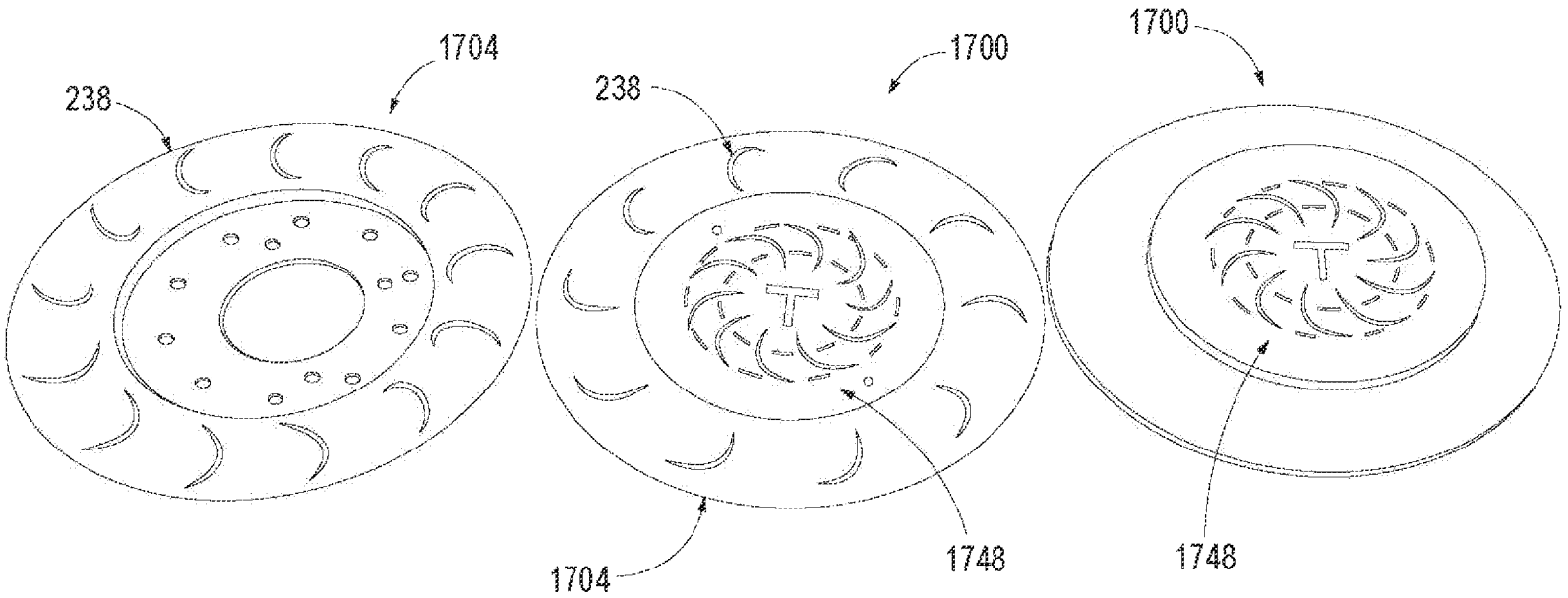
FIG. 21 shows multiple views of a low-profile drain system at various stages of assembly in accordance with embodiments of the present disclosure.

FIG. 21 shows multiple views of a low-profile drain system at various stages of assembly in accordance with embodiments of the present disclosure. The low-profile drain system 1700 shown in FIG. 21 may include a low-profile drain adapter 1704 having a series of mortar receiving features 238 disposed on a top surface of the low-profile drain adapter 1704 around the drain center axis 114 of the low-profile drain adapter 1704. Although these mortar receiving features 238 can have any shape, the mortar receiving features 238 shown in FIG. 21 are configured as arcuate slots passing through the outer flange of the low-profile drain adapter 1704. The first perspective view (left) shown in FIG. 21 illustrates the low-profile drain adapter 1704 alone. The second perspective view (center) of FIG. 21 shows the low-profile drain system 1700 with the drain gate 1748 mounted in a substantially flush state at the most compact height for the low-profile drain system 1700. The third perspective view (right) of FIG. 21 shows the low-profile drain system 1700 with the drain gate 1748 mounted in a raised state at the tallest height for the low-profile drain system 1700. As can be appreciated, the drain gate 1748 may be infinitely adjusted between the compact height and the tallest heights shown in FIG. 21 by screwing/unscrewing the low-profile drain insert 1716 relative to the interface adapter 1712.

The foregoing discussion has been presented for purposes of illustration and description. The foregoing is not intended to limit the disclosure to the form or forms disclosed herein. In the foregoing Detailed Description for example, various features of the disclosure are grouped together in one or more aspects, embodiments, and/or configurations for the purpose of streamlining the disclosure. The features of the aspects, embodiments, and/or configurations of the disclosure may be combined in alternate aspects, embodiments, and/or configurations other than those discussed above. This method of disclosure is not to be interpreted as reflecting an intention that the claims require more features than are expressly recited in each claim. Rather, as the following claims reflect, inventive aspects lie in less than all features of a single foregoing disclosed aspect, embodiment, and/or configuration. Thus, the following claims are hereby incorporated into this Detailed Description, with each claim standing on its own as a separate preferred embodiment of the disclosure.

Moreover, though the description has included description of one or more aspects, embodiments, and/or configurations and certain variations and modifications, other variations, combinations, and modifications are within the scope of the disclosure, e.g., as may be within the skill and knowledge of those in the art, after understanding the present disclosure. It is intended to obtain rights which include alternative aspects, embodiments, and/or configurations to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. A low-profile drain system, comprising:

a drain adapter having an upper surface and a lower surface, the drain adapter including a center axis and a bonding flange extending from the center axis to an outer periphery of the drain adapter, wherein the drain adapter includes a stem having an externally-threaded portion;

a drain insert disposed inside a portion of the drain adapter below the upper surface, the drain insert including an internally-threaded portion configured to threadedly-engage with a drain component other than the drain adapter; and an adjustable flange disposed about and radially outside of the drain insert, the adjustable flange being movable to adjust a height of the drain insert.

2. The low-profile drain system of claim 1, further comprising:

a threaded plate including an internally-threaded portion, the threaded plate including drain base mounting features defining holes extending therethrough and surrounding the internally-threaded portion; and a plate gasket including cuts disposed at points matching the drain base mounting features of the threaded plate, wherein the stem of the drain adapter is threadedly-engaged with the internally-threaded portion of the threaded plate.

3. The low-profile drain system of claim 2, wherein the threaded plate clamps the plate gasket to a drain base via a plurality of fasteners inserted in the drain base mounting features.

4. The low-profile drain system of claim 3, wherein the threaded plate and the plate gasket form a dry seal between the threaded plate and the drain base.

5. The low-profile drain system of claim 3, wherein threads of the internally-threaded portion of the threaded plate match threads of the internally-threaded portion of the drain insert.

6. A low-profile drain system, comprising:

a drain adapter having an upper surface and a lower surface, the drain adapter including a center axis and a bonding flange extending from the center axis to an outer periphery of the drain adapter, wherein the drain adapter includes a stem having an externally-threaded portion and an opposing internally-threaded portion, wherein the externally-threaded portion is axially aligned with and radially outside of the internally-threaded portion, and wherein the internally-threaded portion is configured to threadedly-engage with a drain component other than the drain adapter.

7. The low-profile drain system of claim 6, wherein the drain component is a drain insert including a filter.

8. The low-profile drain system of claim 7, wherein the drain insert includes a tubing portion having a threaded outer diameter configured to threadedly-engage with the internally-threaded portion of the stem.

9. The low-profile drain system of claim 1, wherein the adjustable flange engages the drain insert in a tight tolerance fit.

* * * * *